US006942013B2

(12) United States Patent
Strezov et al.

(10) Patent No.: US 6,942,013 B2
(45) Date of Patent: Sep. 13, 2005

(54) CASTING STEEL STRIP

(76) Inventors: Lazar Strezov, 7 Marin Street, Adamstown Heights, New South Wales, 2289 (AU); Kannappar Mukunthan, 12/21 Ranclaud Street, Merewether, New South Wales 2291 (AU)

( * ) Notice: Subject to any disclaimer, the term of this patent is extended or adjusted under 35 U.S.C. 154(b) by 0 days.

(21) Appl. No.: 10/164,131

(22) Filed: Jun. 5, 2002

(65) Prior Publication Data

US 2003/0000679 A1 Jan. 2, 2003

Related U.S. Application Data

(63) Continuation-in-part of application No. 09/743,638, filed on Mar. 7, 2001, now abandoned.

(30) Foreign Application Priority Data

Aug. 7, 1998 (AU) ..... PP5151

(51) Int. Cl.[7] ..... B22D 11/06

(52) U.S. Cl. ..... 164/480; 164/428; 164/429; 164/479

(58) Field of Search ..... 164/480, 428, 164/479, 429

(56) References Cited

U.S. PATENT DOCUMENTS

| | | | | |
|---|---|---|---|---|
| 4,250,950 A | | 2/1981 | Buxmann et al. | |
| 4,368,084 A | | 1/1983 | Irie et al. | |
| 4,648,438 A | * | 3/1987 | Hazelett et al. | 164/475 |
| 5,227,251 A | | 7/1993 | Suichi et al. | |
| 5,520,243 A | | 5/1996 | Freeman et al. | |
| 5,588,479 A | | 12/1996 | Leadbeatter et al. | |
| 5,651,413 A | * | 7/1997 | Williams et al. | 164/479 |
| 5,701,948 A | | 12/1997 | Strezov et al. | |
| 5,720,336 A | | 2/1998 | Strezov | |
| 6,059,014 A | | 5/2000 | Strezov | |
| 6,120,621 A | | 9/2000 | Jin et al. | |

FOREIGN PATENT DOCUMENTS

| | | |
|---|---|---|
| EP | 800881 | 10/1997 |
| FR | 1 364.717 | 5/1964 |
| JP | 60-40650 | 3/1985 |
| WO | WO 95/13889 | 5/1995 |

OTHER PUBLICATIONS

Patent Abstract of Japan vol. 015. No. 333 Aug. 23, 1991 and JP 03 128149a (Ishikawajima Harima Heavy Ind Co Ltd). May 31, 1991: "Twin Roll Type Continuous Casting Machine". Heji Kato.

Patent Abstract of Japan vol. 018. No. 435. Aug. 15, 1994 & JP 06 134553 a (Nippon Steel Corp) May 17, 1994. "Mold for continuously Casting Thin Cast Slab and Method for Working Surface Thereof".

Patent Abstract of Japan vol. 1997. No. 03. Mar. 31, 1997 & JP 08 294751 A (Nippon Steel Corp). Nov. 12, 1996. "Casting Drum of Twin Drum Type Continuous Casting Machine." Ogibayashi Shigeaki.

Patent Abstract of Japan vol. 016. No. 217. May 21, 1992 & JP 04 041052 A (Nippon Steel Corp). Feb. 12, 1992. "Method for Continuously Casting Cast Strip." Kajioka Hiroyuki.

* cited by examiner

*Primary Examiner*—Kuang Y. Lin

(57) ABSTRACT

In twin roll casting of steel strip, molten steel is introduced into the nip between parallel casting rolls to create a casting pool supported on casting surfaces of the rolls and the rolls are rotated to deliver solidified strip downwardly from the nip. Casting surfaces are textured by a random pattern of discrete projections at least some of which include peaks having a surface distribution of between 5 and 200 projections per mm$^2$ and an average height of at least 10 microns. The random texture may be produced by grit blasting the casting surfaces on a substrate covered by a protective coating. Alternatively the texture may be produced by chemical deposition or electrodeposition of a coating onto a substrate to form the casting surfaces.

33 Claims, 24 Drawing Sheets

DMC-74/24, SURFACE NUCLEATION (CHATTER), Textured Cr - (180 x 20 μm), 0.05C-0.6Mn-0.3Si-<0.01S
1580°C Melt Temp., W.B., 30 m/min

MAG. X50

DMC-74/24, SOLIDIFICATION STRUCTURE (CHATTER), Textured Cr - (180 x 20 μm), 0.05C-0.6Mn-0.3Si-<0.01S 1580°C Melt Temp., W.B., 30 m/min Longitudinal Section, MAG. X50, (D363)

DMC-74/4, SURFACE NUCLEATION (CHATTER), Textured Cr - (180 x 60 μm), 0.05C-0.6Mn-0.3Si-<0.01S
1580°C Melt Temp., W.B., 60 m/min

MAG. X50

DMC-74/4, SOLIDIFICATION STRUCTURE (CHATTER), Textured Cr - (180 x 60 μm), 0.05C-0.6Mn-0.3Si-<0.01S 1580°C Melt Temp., W.B., 60 m/min Longitudinal Section, MAG. X50, (D362)

SURFACE NUCLEATION, Ridge Textures: 180x20 and 180x60, (0.06 C, 0.01 S)
(After several no cleaning steps)

180x20 ridges

180x60 ridges

MAGNIFICATION X100

SURFACE NUCLEATION, PYRAMID AND GRIT BLAST SUBSTRATES, (0.06 C, 0.01 S)

(After several no cleaning steps)

Pyramid (160x20)

Grit Blast (Ra = 10)

MAGNIFICATION X100

DMC82 - 30, Solidification Structure, N.C., 60 m/min
MO6 (0.007S, 0.44Cu), (0.009Cr, 0.003Mo, 0.02Ni, 0.003Sn)

8 Ra Grit Blast Cr
Transverse section (Mag X50) sample D430

DMC82 - 30, Solidification Structure, N.C., 60 m/min
MO6 (0.007S, 0.44Cu), (0.009Cr, 0.003Mo, 0.02Ni, 0.003Sn)

180 x 60 sharp Cr ridges
Transverse section (Mag X50) sample D430

Dip Test Solidification Structures - Ex. DMC58 - 37

MO6 (0.024% S, 0.21% Cu), 180 x 20μ Cr Substrate, No Cleaning

Transverse Section (Mag X50)

Dip Test Solidification Structure Ex. DMC58 - 62

MO6 (0.024% S, 0.21% Cu), NiMoCo Substrate - 2 Ra, No Cleaning

Transverse section (Mag X50)

Dip Test Solidification Structures - Ex. DMC58 - 62

MO6 (0.024% S, 0.21% Cu), NiCrMo Substrate - 6 Ra, No Cleaning

Transverse Section (Mag X50)

23
39
11
96
97
99
101
40
33
42
43
32
32
13
31
14
37
34
16
16
60
19
55
81
56
81
38
15

CASTING STEEL STRIP

RELATED APPLICATIONS

This application is a continuation-in-part of U.S. application Ser. No. 09/743,638 filed 07 Mar. 2001, now abandoned, which application claims priority to International Application No. PCT/AU99/00641 filed 06 Aug. 1999, which International application claims priority to Australian Provisional Patent Application No. PP5151 filed 07 Aug. 1998.

BACKGROUND AND SUMMARY

This invention relates to the casting of steel strip.

It is known to cast metal strip by continuous casting in a twin roll caster. In this technique molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of vessels from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed.

Although twin roll casting has been applied with some success to non-ferrous metals which solidify rapidly on cooling, there have been problems in applying the technique to the casting of ferrous metals. One particular problem has been the achievement of sufficiently rapid and even cooling of metal over the casting surfaces of the rolls. In particular it has proved difficult to obtain sufficiently high cooling rates for solidification onto casting rolls with smooth casting surfaces and it has therefore been proposed to use rolls having casting surfaces which are deliberately textured by a regular pattern of projections and depressions to enhance heat transfer and so increase the heat flux achieved at the casting surfaces during solidification.

Our U.S. Pat. No. 5,701,948 discloses a casting roll texture formed by a series of parallel groove and ridge formations. More specifically, in a twin roll caster the casting surfaces of the casting rolls may be textured by the provision of circumferentially extending groove and ridge formations of essentially constant depth and pitch. This texture produces enhanced heat flux during metal solidification and can be optimized for casting of steel in order to achieve both high heat flux values and a fine microstructure in the as-cast steel strip. Essentially when casting steel strip, the depth of the texture from ridge peak to groove root should be in the range 5 microns to 50 microns and the pitch of the texture should be in the range 100 to 250 microns for best results. For optimum results it is preferred that the depth of the texture be in the range 15 to 25 microns and that the pitch be between 150 and 200 microns.

Although rolls with the texture disclosed in U.S. Pat. No. 5,701,948 have enabled achievement of high solidification rates in the casting of ferrous metal strip it has been found that they exhibit a marked sensitivity to the casting conditions which must be closely controlled to avoid two general kinds of strip defects known as "crocodile-skin" and "chatter" defects. More specifically it has been necessary to control crocodile-skin defects by the controlled addition of sulphur to the melt and to avoid chatter defects by operating the caster within a narrow range of casting speeds.

The crocodile-skin defect occurs when $\delta$ and $\gamma$ iron phases solidify simultaneously in shells on the casting surfaces of the rolls in a twin roll caster under circumstances in which there are variations in heat flux through the solidifying shells. The $\delta$ and $\gamma$ iron phases have differing hot strength characteristics and the heat flux variations then produce localized distortions in the solidifying shells which come together at the nip between the casting rolls and result in the crocodile-skin defects in the surfaces of the resulting strip.

A light oxide deposit on the rolls having a melting temperature below that of the metal being cast can be beneficial in ensuring a controlled even heat flux during metal solidification on to the casting roll surfaces. The oxide deposit melts as the roll surfaces enter the molten metal casting pool and assists in establishing a thin liquid interface layer between the casting surface and the molten metal of the casting pool to promote good heat flux. However, if there is too much oxide build up the melting of the oxides produces a very high initial heat flux but the oxides then resolidify with the result that the heat flux decreases rapidly. This problem has been addressed by endeavoring to keep the build up of oxides on the casting rolls within strict limits by complicated roll cleaning devices. However, where roll cleaning is non-uniform there are variations in the amount of oxide build up with the resulting heat flux variations in the solidifying shells producing localized distortions leading to crocodile-skin surface defects.

Chatter defects are initiated at the meniscus level of the casting pool where initial metal solidification occurs. One form of chatter defect, called "low speed chatter", is produced at low casting speeds due to premature freezing of the metal high up on the casting rolls so as to produce a weak shell which subsequently deforms as it is drawn further into the casting pool. The other form of chatter defect, called "high speed chatter", occurs at higher casting speeds when the shell starts forming further down the casting roll so that there is liquid above the forming shell. This liquid, which feeds the meniscus region, cannot keep up with the moving roll surface, resulting in slippage between the liquid and the roll in the upper part of the casting pool, thus giving rise to high speed chatter defects appearing as transverse deformation bands across the strip.

Moreover, to avoid low speed chatter on the one hand and high speed chatter on the other, it has been necessary to operate within a very narrow window of casting speeds. Typically it has been necessary to operate at a casting speed within a narrow range of 30 to 32 meters per minute. The specific speed range can vary from roll to roll, but in general the casting speed must be well below 40 meters per minute to avoid high speed chatter.

We have now determined that it is possible to produce a roll casting surface which is much less prone to generation of chatter defects and which enables the casting of steel strip at casting speeds well in excess of what has hitherto been possible without producing strip defects. Moreover, the casting surface provided in accordance with the invention is also relatively insensitive to conditions causing crocodile-skin defects and it is possible to cast steel strip without crocodile-skin defects.

According to the invention there is provided a method of continuously casting steel strip comprising the steps of supporting a casting pool of molten steel on one or more chilled casting surfaces textured by a random pattern of discrete projections wherein at least some of the projections include peaks having an average surface distribution of between 5 and 200 projections per $mm^2$; and moving the chilled casting surface or surfaces to produce a solidified strip moving away from the casting pool.

The random pattern of discrete projections is such as are produced by grit blasting the casting surface as hereinafter described. As noted, the discrete projections may have peaks. These peaks may be pointed peaks, but generally because of the nature of their formation, such discrete projections do not have such pointed peaks. It has been found that the peaks of the discrete projections have flat areas of typically 100 to 400 square microns due to the nature of formation, e.g., grit blasting. The discrete projections may have peaks that have an average distribution of between 5 and 200 peaks per $mm^2$, with average peak distributions above 100 peaks per $mm^2$ used with higher casting speeds. The average height of the discrete projections may be at least 10 microns and may also be at least 20 microns.

Therefore, in another illustrative embodiment, the average height of the discrete projections is at least 10 microns.

In yet another illustrative embodiment, the average height of the discrete projections is at least 20 microns.

Illustratively, the strip is moved away from the casting pool at a speed of more than 40 meters per minute. For example, the method permits the strip to be moved away at a speed of between 50 and 65 meters per minute.

The molten steel may be a low residual steel having a sulphur content of not more than 0.025%.

In another illustrative embodiment, at least some of the projections include peaks having an average surface distribution of between 10 and 100 peaks per $mm^2$ and an average height of at least 10 microns. It will be appreciated that the average height of the discrete projections may be at least 20 microns in an alternative embodiment. Furthermore, the strip may be moved away from the casting pool at a speed of more than 40 meters per minute. For example, this illustrative method permits the strip to be moved away at a speed of between 50 and 65 meters per minute. Also in this illustrative embodiment, the molten steel may be a low residual steel having a sulphur content of not more than 0.025%.

The method of the present invention may be carried out in a twin roll caster.

Accordingly the invention further provides a method of continuously casting steel strip of the kind in which molten metal is introduced into the nip between a pair of parallel casting rolls via a metal delivery nozzle disposed above the nip to create a casting pool of molten steel supported on casting surfaces of the rolls immediately above the nip and the casting rolls are rotated to deliver a solidified steel strip downwardly from the nip, wherein the casting surfaces of the rolls are each textured by a random pattern of discrete projections, at least some of which include peaks having an average surface distribution of between 5 and 200 peaks per $mm^2$ and an average height of at least 10 microns. In an alternative embodiment, at least some of the projections may include peaks having an average surface distribution of between 10 and 100 peaks per $mm^2$. In an alternative embodiment the discrete projections may have an average height of at least 20 microns.

The invention further extends to apparatus for continuously casting steel strip comprising a pair of casting rolls forming a nip between them, a molten steel delivery nozzle for delivery of molten steel into the nip between the casting rolls to form a casting pool of molten steel supported on casting roll surfaces immediately above the nip, and a roll drive that moves the casting rolls in counter-rotational directions to produce a solidified strip of metal delivered downwardly from the nip, wherein the casting surfaces of the rolls are each textured by a random pattern of discrete projections, at least some of which include peaks having an average surface distribution of between 5 and 200 peaks per $mm^2$. In another illustrative embodiment, at least some of the projections may include peaks having an average surface distribution of between 10 and 100 peaks per $mm^2$. Illustratively, the discrete projections may have an average height of at least 10 microns. In another illustrative embodiment, the discrete projections may have an average height of at least 20 microns.

A textured casting surface in accordance with the invention can be achieved by grit blasting the casting surface or a metal substrate which is protected by a surface coating to produce the casting surface. For example each casting surface may be produced by grit blasting a copper substrate which is subsequently plated with a thin protective layer of chrome. Alternatively, the casting surface may be formed of nickel in which case the nickel surface may be grit blasted and no protective coating applied.

The required texture of the or each casting 5 surface may alternatively be obtained by deposition of a coating onto a substrate. In this case the material of the coating may be chosen to promote high heat flux during metal solidification. Said material may be a material which has a low affinity for the steel oxidation products so that wetting of the casting surfaces by those deposits is poor. More particularly the casting surface may be formed of an alloy of nickel chromium and molybdenum or alternatively an alloy of nickel molybdenum and cobalt, the alloy being deposited so as to produce the required texture.

BRIEF DESCRIPTION OF THE DRAWINGS

In order that the invention may be more fully explained the results of experimental work carried out to date will be described with reference to the accompanying drawings in which.

DETAILED DESCRIPTION OF THE DRAWINGS

Figure 1:
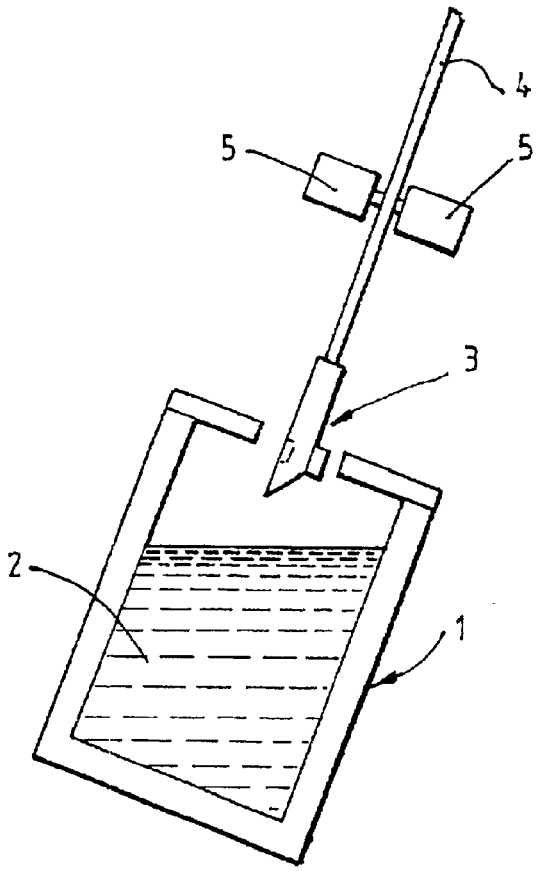
FIG. 1 illustrates experimental apparatus for determining metal solidification rates under conditions simulating those of a twin roll caster.
Figure 2:
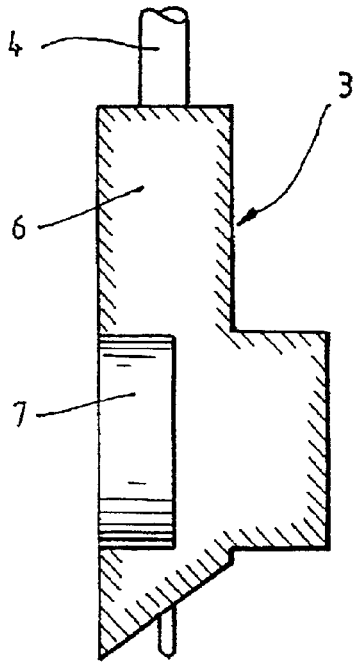
FIG. 2 illustrates an immersion paddle incorporated in the experimental apparatus of FIG. 1.

FIGS. 1 and 2 illustrate a metal solidification test rig in which a 40 mm×40 mm chilled block is advanced into a bath of molten steel at such a speed as to closely simulate the conditions at the casting surfaces of a twin roll caster. Steel solidifies onto the chilled block as it moves through the molten bath to produce a layer of solidified steel on the surface of the block. The thickness of this layer can be measured at points throughout its area to map variations in the solidification rate and therefore the effective rate of heat transfer at the various locations. It is thus possible to produce an overall solidification rate as well as total heat flux measurements. It is also possible to examine the microstructure of the strip surface to correlate changes in the solidification microstructure with the changes in observed solidification rates and heat transfer values.

The experimental rig illustrated in FIGS. 1 and 2 comprises an induction furnace 1 containing a melt of molten metal 2 in an inert atmosphere which may for example be provided by argon or nitrogen gas. An immersion paddle denoted generally as 3 is mounted on a slider 4 which can be advanced into the melt 2 at a chosen speed and subsequently retracted by the operation of computer controlled motors 5.

Immersion paddle 3 comprises a steel body 6 which contains a substrate 7 in the form of a chrome plated copper block measuring 40 mm×40 mm. It is instrumented with thermocouples to monitor the temperature rise in the substrate which provides a measure of the heat flux. In the ensuing description it will be necessary to refer to a quantitative measure of the smoothness of casting surfaces. One specific measure used in our experimental work and helpful in defining the scope of the present invention is the standard measure known as the Arithmetic Mean Roughness Value which is generally indicated by the symbol R~. This value is defined as the arithmetical average value of all absolute distances of the roughness profile from the centre line of the profile within the measuring length 1*a*. The centre line of the profile is the line about which roughness is measured and is a line parallel to the general direction of the profile within the limits of the roughness-width cut-off such that sums of the areas contained between it and those parts of the profile which lie on either side of it are equal. The Arithmetic Mean Roughness Value may be defined as:

$$R_a = 1/1_m \int_{x=0}^{x=l_m} |y| dx$$

Tests carried out on the experimental rig illustrated in FIGS. 1 and 2 have demonstrated that the sensitivity to chatter and crocodile-skin defects experienced when casting onto a casting surface textured by a regular pattern of ridges can be avoided by employing a casting surface textured by a random pattern of discrete projections with pointed peaks. The random pattern texture can be achieved by grit blasting and will generally result in an Arithmetic Mean Roughness Value of the order of 5 to 10 Ra but, as explained below, the controlling parameters are the surface density of the peak projections and the minimum depth of the projections rather than the roughness value.

The testing has further demonstrated that the sensitivity of ridged textures to crocodile-skin and chatter defects is due to the extended surfaces along the ridges along which oxides can build up and melt. The melted oxide flows along the ridges to produce continuous films which dramatically increase heat transfer over substantial areas along the ridges. This increases the initial or peak heat flux values experienced on initial solidification and result in a subsequent dramatic reduction in heat flux on solidification of the oxides which leads to crocodile-skin defects. With a casting surface having a texture formed by a random pattern of sharp peaked projections the oxides can only spread on the individual peaks rather than along extended areas as in the ridged texture. Accordingly, the melted oxides cannot spread over an extended area to dramatically increase the initial heat flux. This surface is therefore much less sensitive to crocodile-skin defects and it has been also shown that it does not need to be cleaned so thoroughly as the ridged texture to avoid such defects.

The tests have also demonstrated that the random pattern texture is much less prone to chatter defects and permits casting of low residual steels with low sulphur content at extremely high casting speeds of the order of 60 meters per minute. Because the initial heat flux on solidification is reduced as compared with the ridged texture low speed chatter defects do not occur. At high speed casting, although slippage between the melt and the casting surface will occur, this does not result in cracking. It is believed that this is for two reasons. Firstly because the initial heat transfer rate is relatively low (of the order of 15 megawatts/$m^2$ as compared with 25 megawatts/$m^2$ for a ridged texture), the intermittent loss of contact due to slippage does not result in such large local heat transfer variations in the areas of slippage. Moreover, the randomness of the pattern of the texture pattern results in a microstructure which is very resistant to crack propagation. The discrete projections of this random texture so formed may have pointed peaks, but because of the nature of formation (e.g., by grit blasting) will typically have relatively flat areas at the peaks of 100 to 400 square microns.

Figure 3:
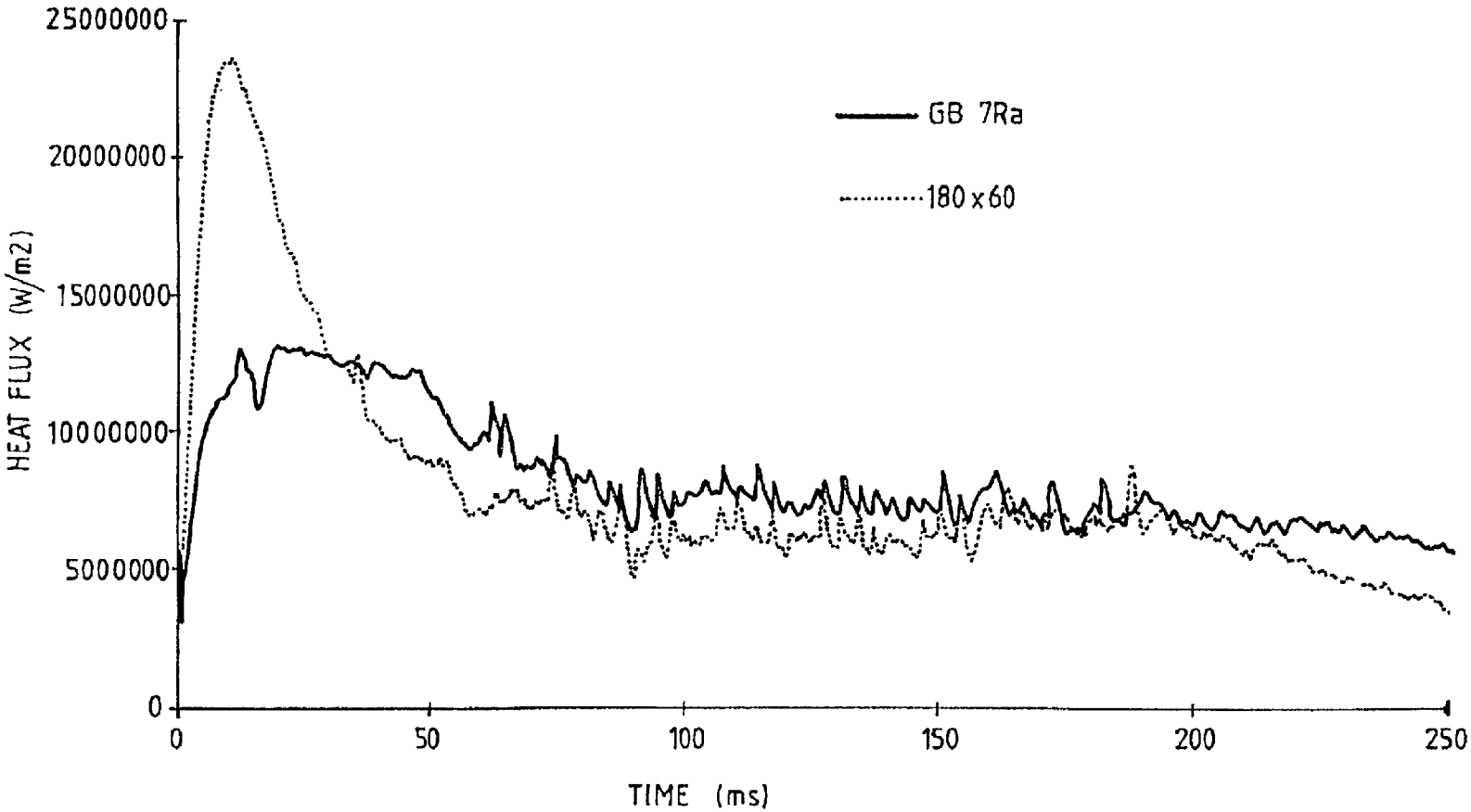
FIG. 3 indicates heat flux values obtained during solidification of steel samples on a textured substrate having a regular pattern of ridges at a pitch of 180 microns and a depth of 60 microns and compares these with values obtained during solidification onto a grit blasted substrate.

FIG. 3 plots heat flux values obtained during 10 solidification of steel samples on two substrates, the first having a texture formed by machined ridges having a pitch of 180 microns and a depth of 60 microns and the second substrate being grit blasted to produce a random pattern of sharply peaked projections having a surface density of the order of 20 peaks per $mm^2$ and an average texture depth of about 30 microns, the substrate exhibiting an Arithmetic Mean Roughness Value of 7 Ra. It will seen that the grit blasted texture produced a much more even heat flux throughout the period of solidification. Most importantly it did not produce the high peak of initial heat flux followed by a sharp decline as generated by the ridged texture which, as explained above, is a primary cause of crocodile-skin defects. The grit blasted surface or substrate produced lower initial heat flux values followed by a much more gradual decline to values which remained higher than those obtained from the ridged substrate as solidification progressed.

Figure 4:
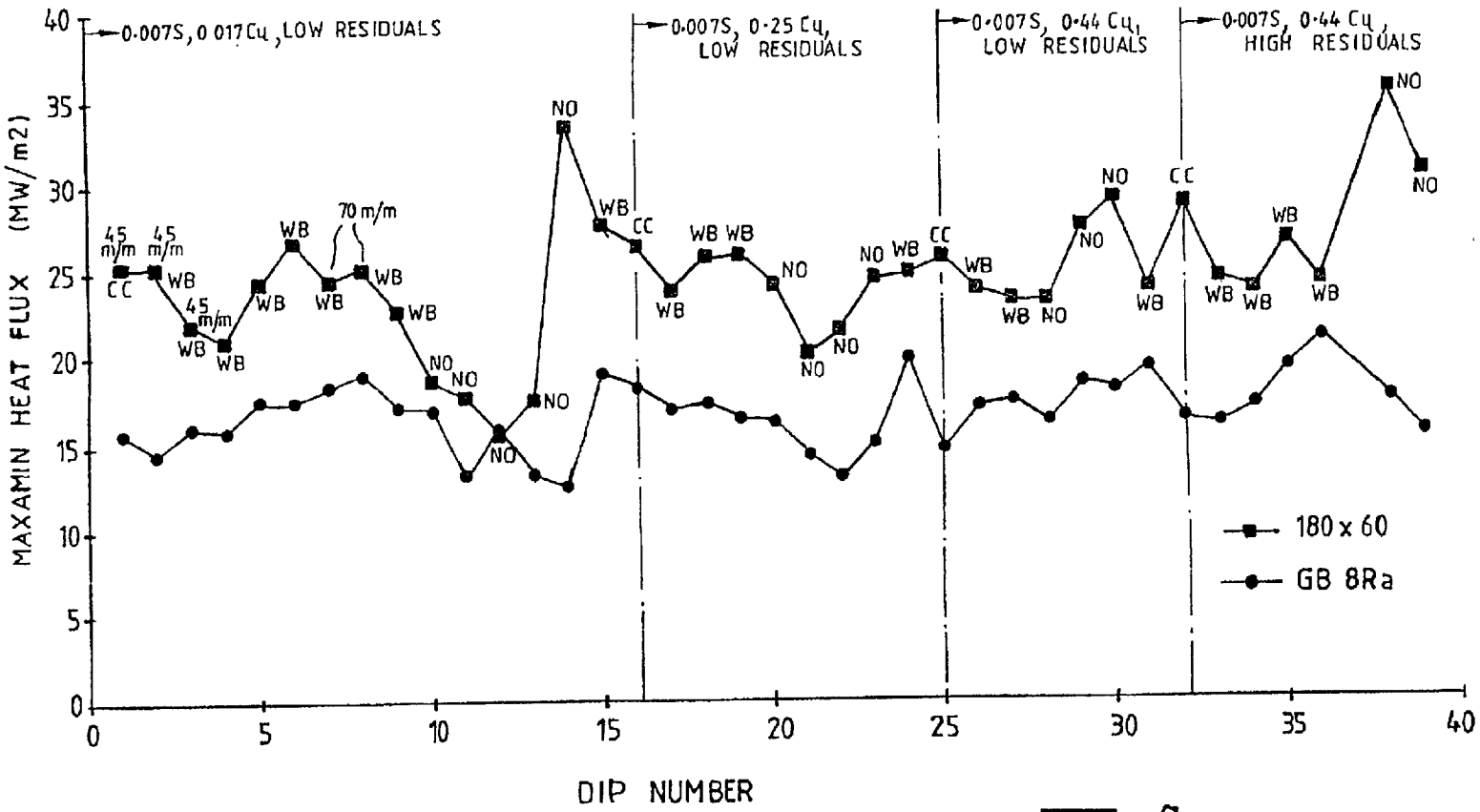
FIG. 4 plots maximum heat flux measurements obtained during successive dip tests in which steel was solidified from four different melts onto ridged and grit blasted substrates.
Figure 5:
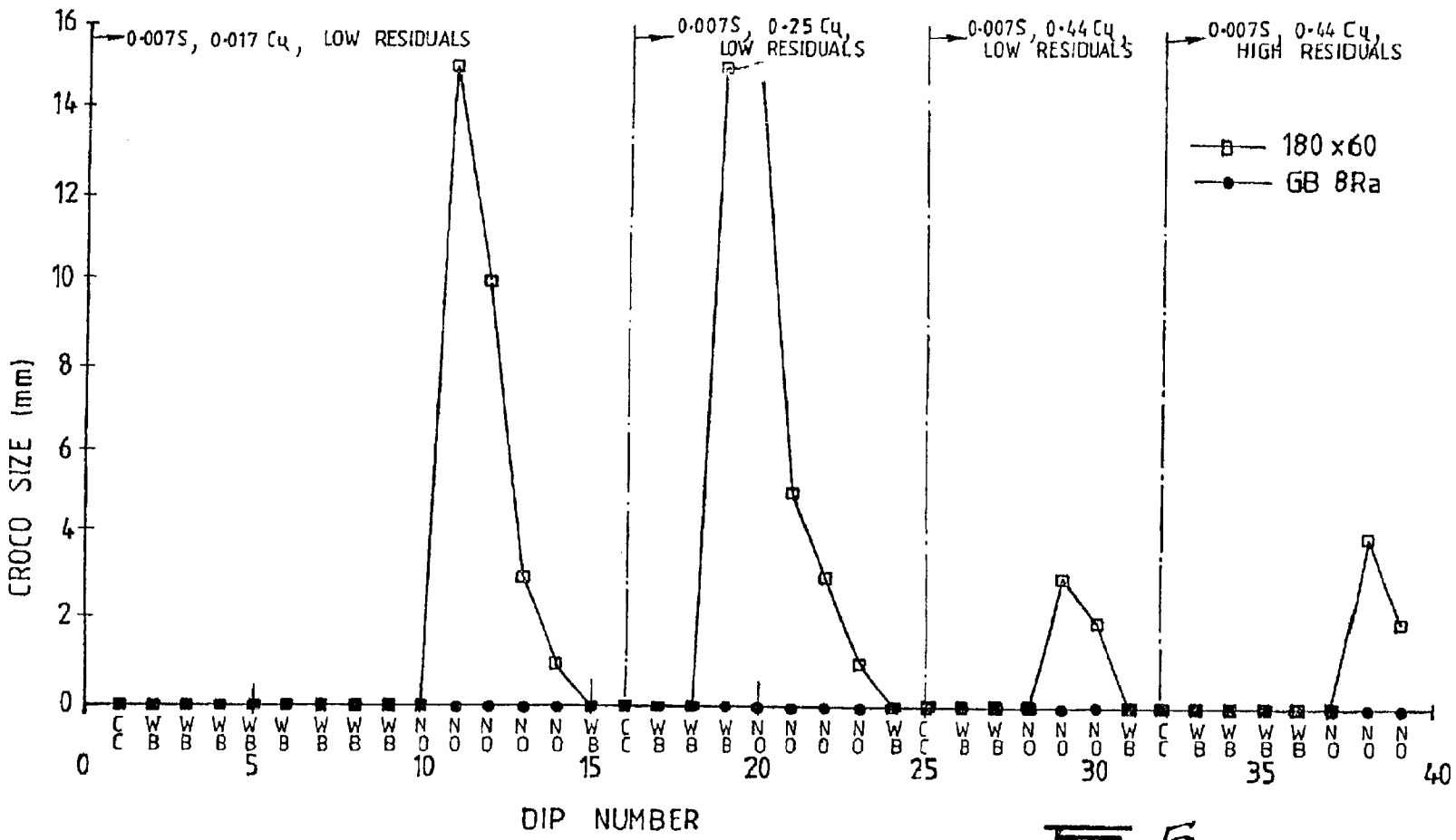
FIG. 5 indicates the results of physical measurements of crocodile-skin defects in the solidified shells obtained from the dip tests of FIG. 4.
Figure 6:
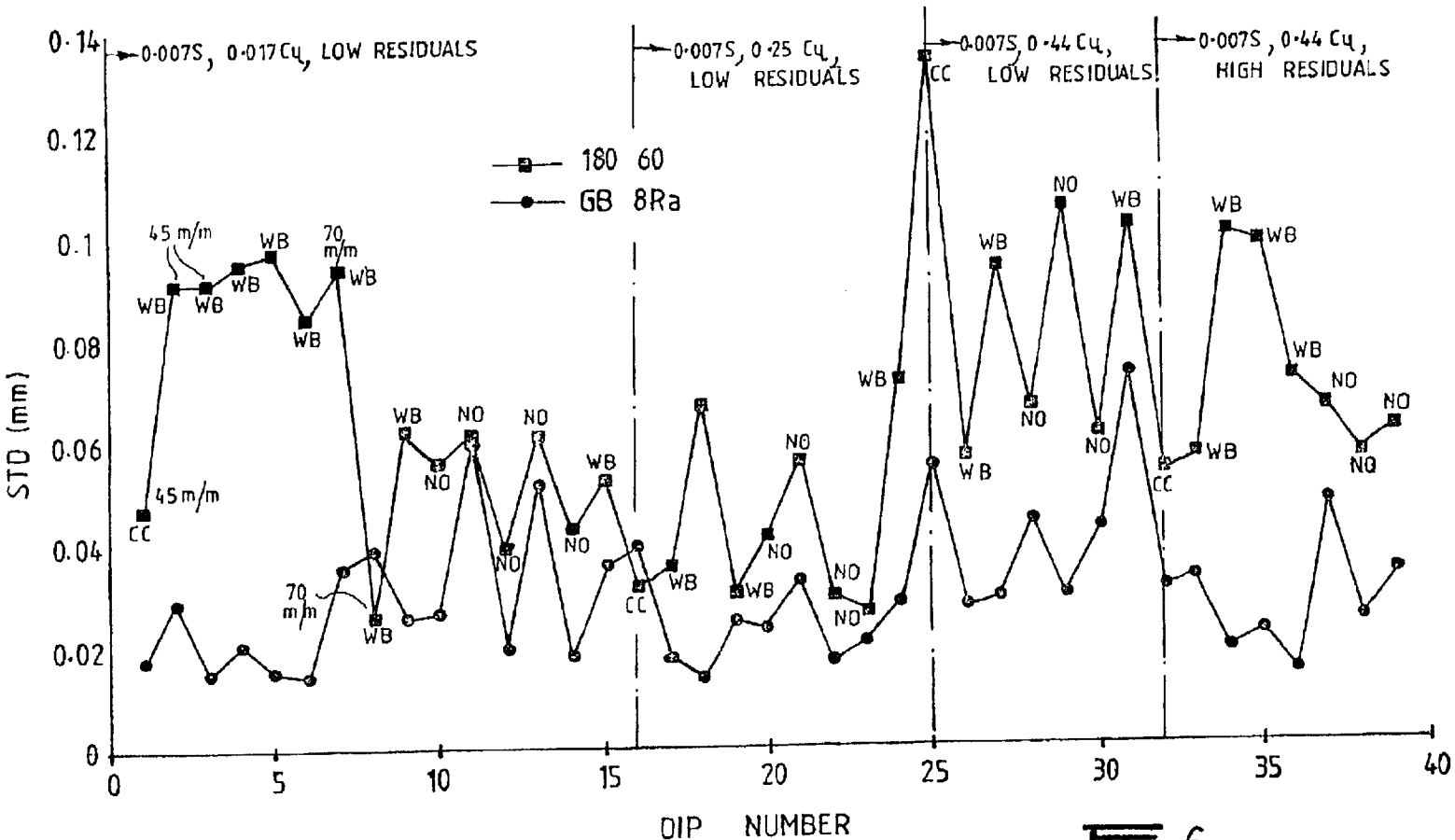
FIG. 6 indicates the results of measurements of 5 standard deviation of thickness of the solidified shells obtained in the dip tests of FIG. 4.

FIG. 4 plots maximum heat flux measurements obtained on successive dip tests using a ridged substrate having a pitch of 180 microns and a ridge depth of 60 microns and a grit blasted substrate. The tests proceeded with solidification from four steel melts of differing melt chemistries. The first three melts were low residual steels of differing copper content and the fourth melt was a high residual steel melt. In the case of the ridged texture the substrate was cleaned by wire brushing for the tests indicated by the letters WE but no brushing was carried out prior to some of the tests as indicated by the letters NO. No brushing was carried out prior to any of the successive tests using the grit blasted substrate. It will be seen that the grit blasted substrate produced consistently lower maximum heat flux values than the ridged substrate for all steel chemistries and without any brushing. The textured substrate produced consistently higher heat flux values and dramatically higher values when brushing was stopped for a period, indicating a much higher sensitivity to oxide build-up on the casting surface. The shells solidified in the dip tests to which FIG. 4 refers were examined and crocodile-skin defects measured. The results of these measurements are plotted in FIG. 5. It will be seen that the shells deposited on the ridged substrate exhibited substantial crocodile defects whereas the shells deposited on the grit blasted substrate showed no crocodile defects at all. The shells were also measured for overall thickness at locations throughout their total area to derive measurements of standard deviation of thickness which are set out in FIG. 6. It will be seen that the ridged texture produced much wider fluctuations in standard deviation of thickness than the shells solidified onto the grit blasted substrate.

Figure 7:
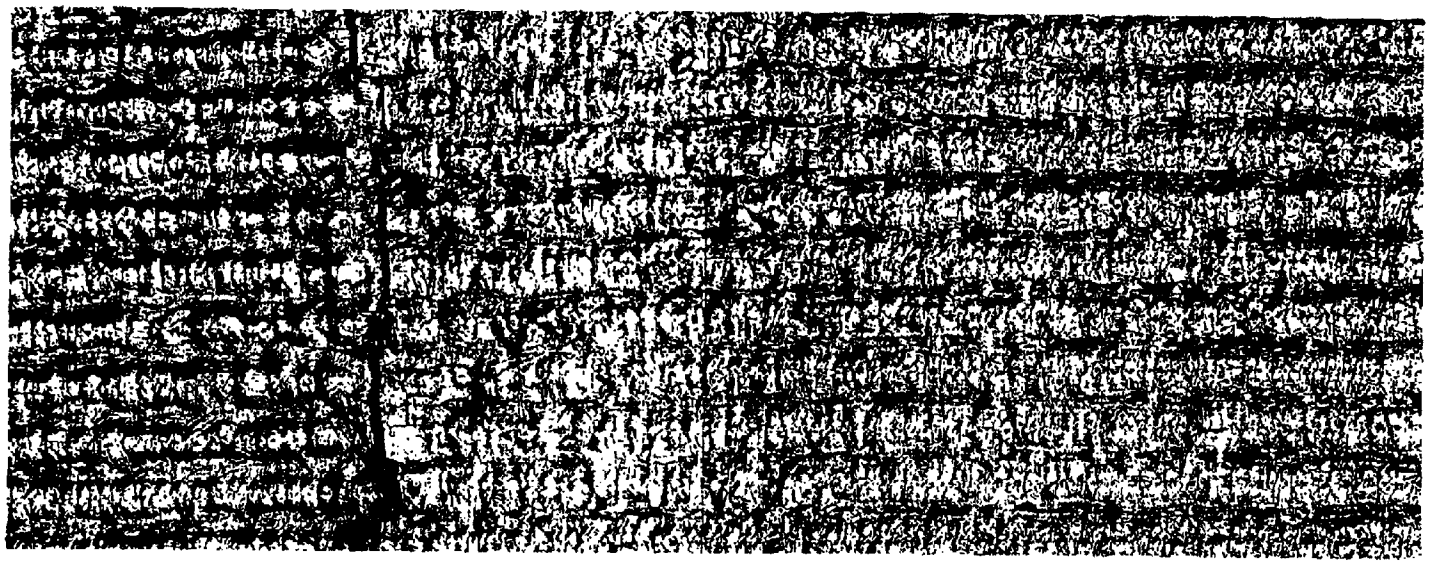
FIG. 7 is a photomicrograph of the surface of a shell of a low residual steel of low sulphur content solidified onto a ridged substrate at a low casting speed and exhibiting a low speed chatter defect.
Figure 8:
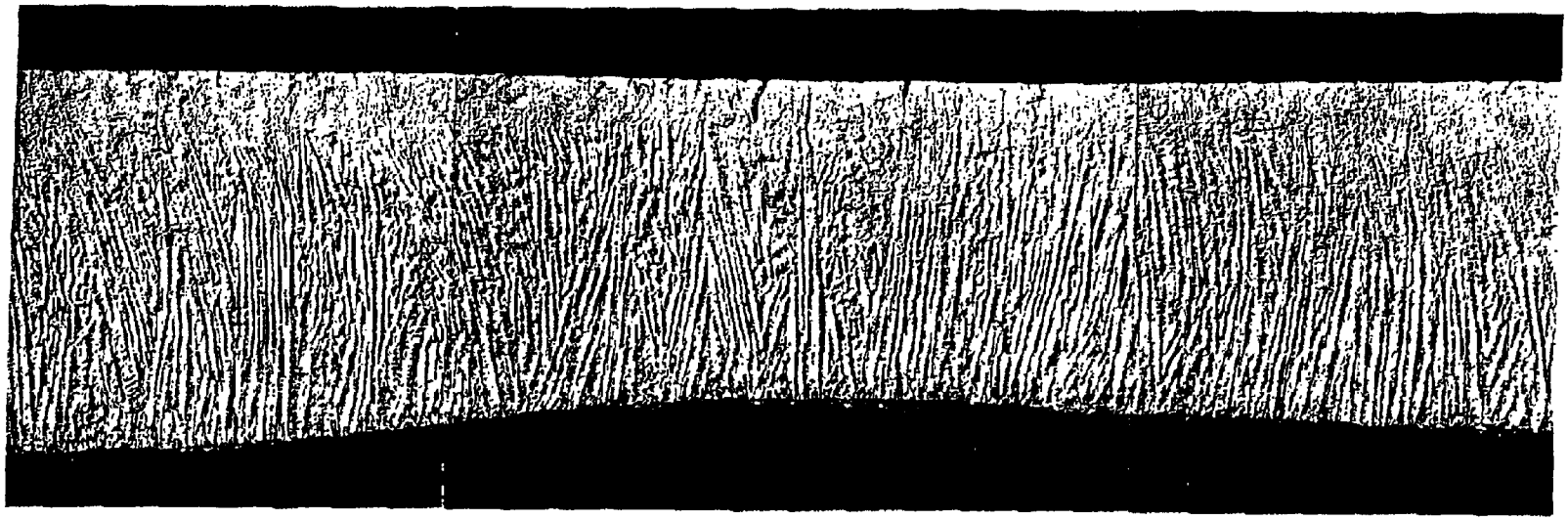
FIG. 8 is a longitudinal section through the shell of FIG. 7 at the position of the low speed chatter defect.

FIG. 7 is a photomicrograph of the surface of a 25 shell solidified onto a ridged texture of 180 microns pitch and 20 micron depth from a steel melt containing by weight 0.05% carbon, 0.6% manganese, 0.3% silicon and less than 0.01% sulphur. The shell was deposited from a melt at 1580° C. at an effective strip casting speed of 30 m/min. The strip exhibits a low speed chatter defect in the form of clearly visible transverse cracking. This cracking was produced during initial solidification and it will be seen that there is no change in the surface microstructure above and below the defect. FIG. 8 is a longitudinal section through the same strip as seen in FIG. 7. The transverse surface cracking can be clearly seen and it will also be seen that there is thinning of the strip in the region of the defect.

Figure 9:
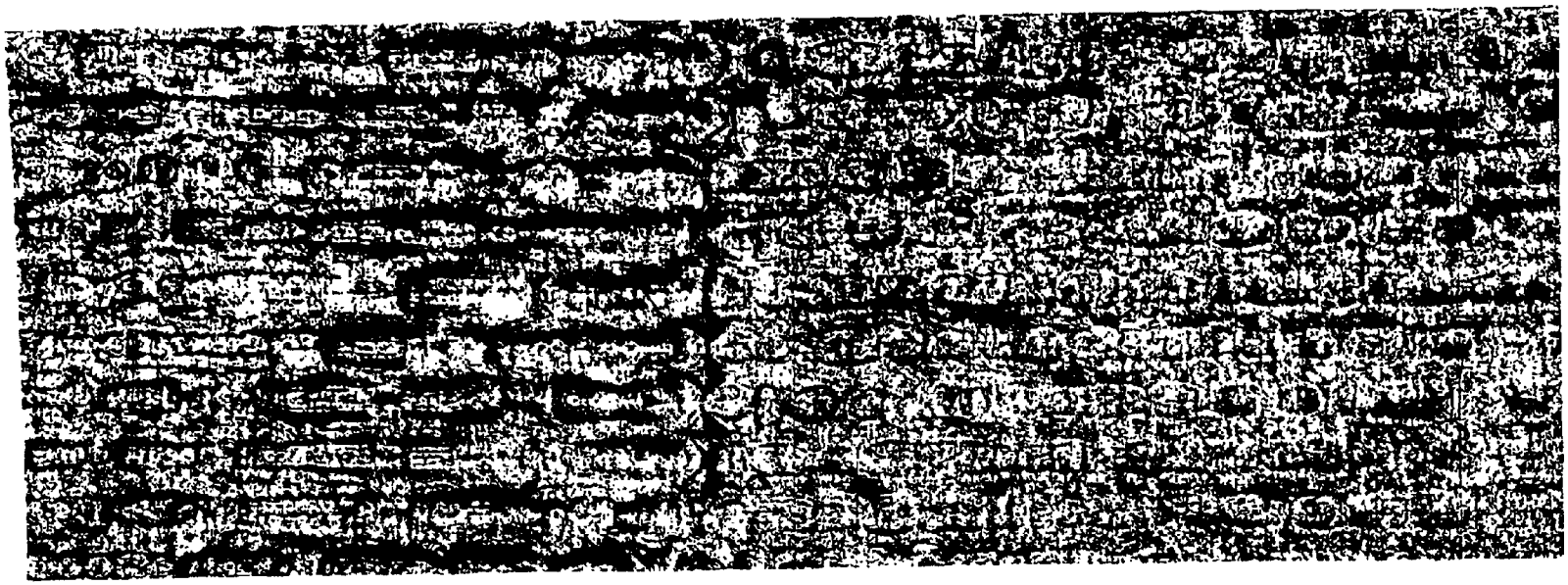
FIG. 9 is a photomicrograph showing the surface 15 of a shell of steel of low sulphur content solidified onto a ridged substrate at a relatively high casting speed and exhibiting a high speed chatter defect.
Figure 10:
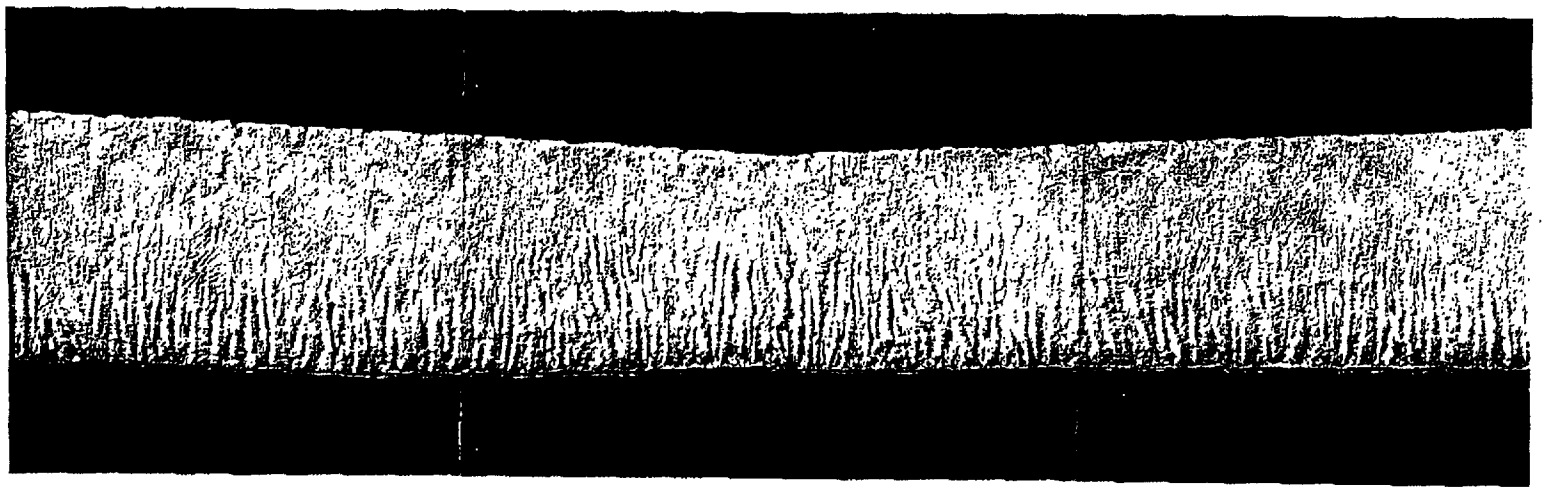
FIG. 10 is a longitudinal cross-section through the shell of FIG. 9 further illustrating the nature of the high speed chatter defect.

FIGS. 9 and 10 are photomicrographs showing the surface structure and a longitudinal section through a shell deposited on the same ridged substrate and from the same steel melt as the shell as FIGS. 7 and 8 but at a much higher effective casting speed of 60 m/min. The strip exhibits a high speed chatter defect in the form of a transverse zone in which there is substantial thinning of the strip and a marked difference in microstructure above and below the defect, although there is no clearly visible surface cracking in the section of FIG. 10.

Figure 11:
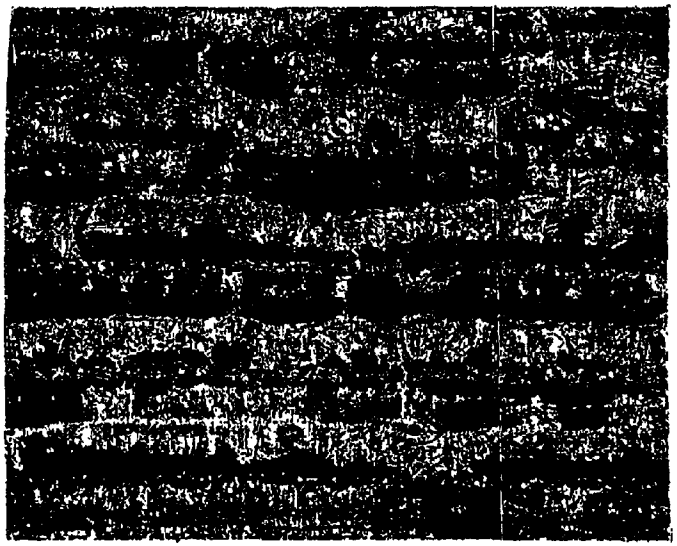
FIGS. 11 and 12 are photomicrographs of the surfaces of shells formed on ridged substrates having differing ridge depths.
Figure 12:
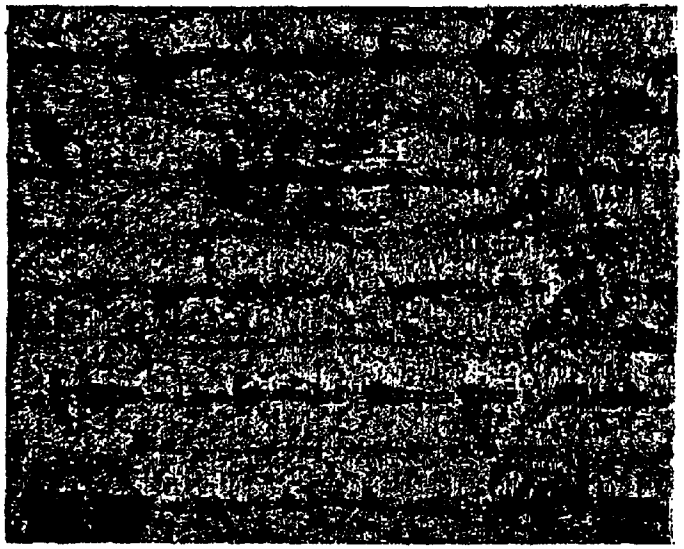
Figure 13:
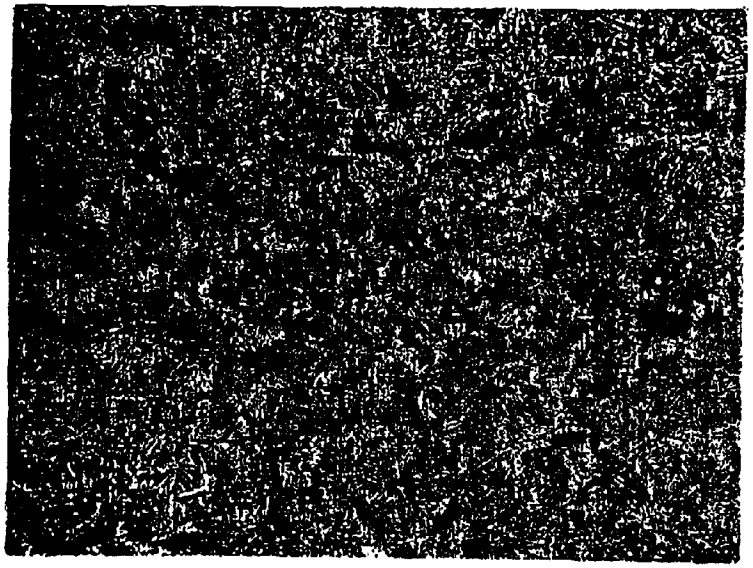
FIG. 13 is a photomicrograph of the surface of 25 a shell solidified onto a substrate textured by a regular pattern of pyramid projections.
Figure 14:
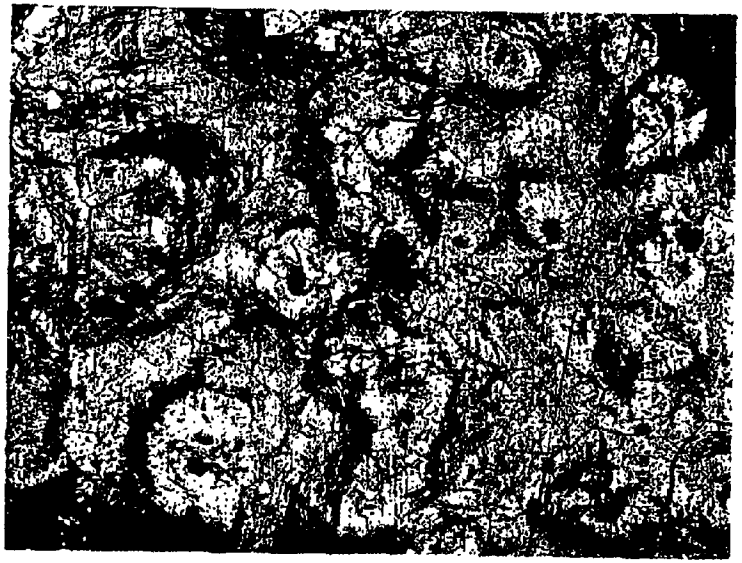
FIG. 14 is a photomicrograph of the surface of a steel shell solidified onto a grit blasted substrate.
Figure 15:
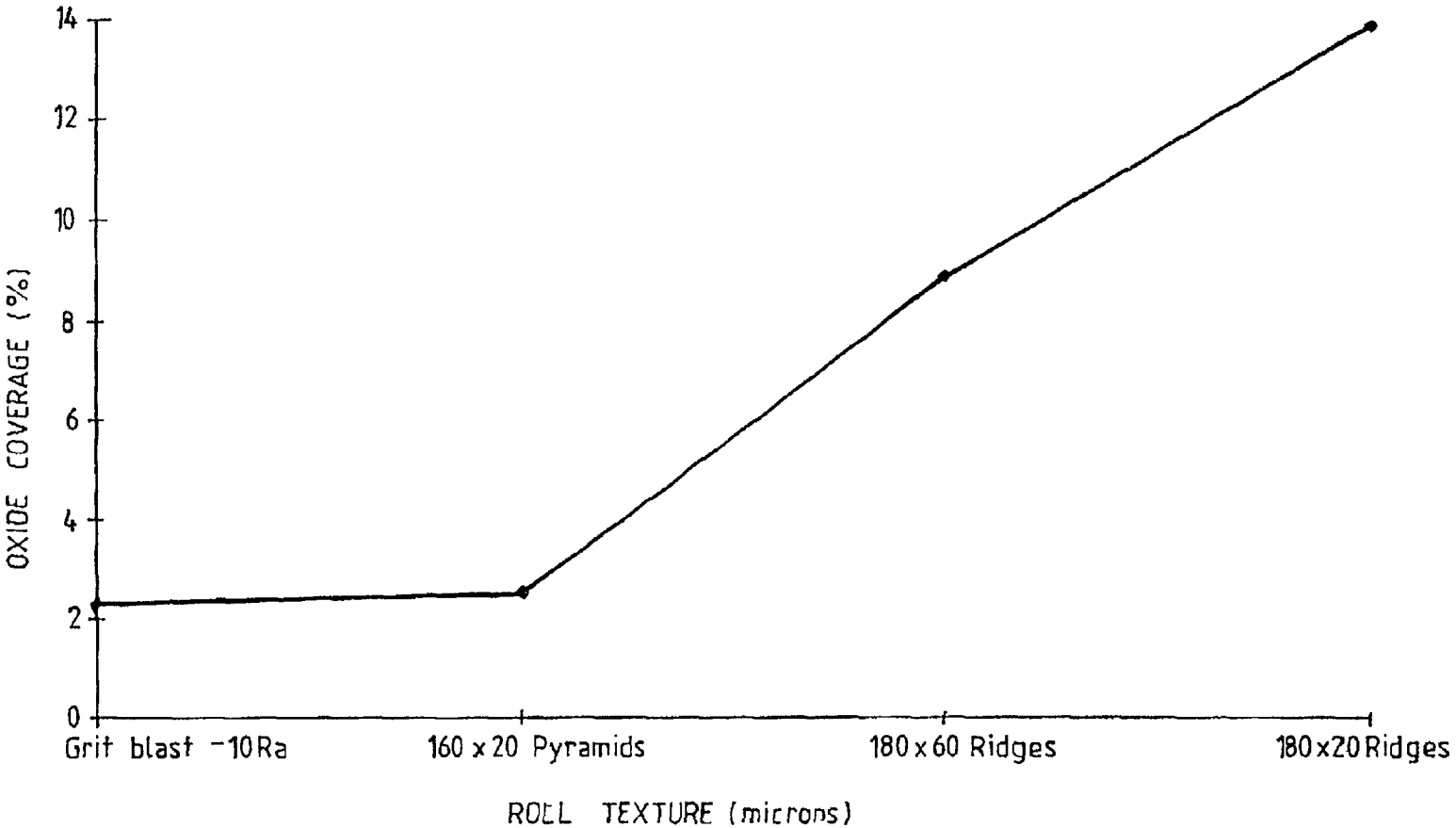
FIG. 15 plots the values of percentage melt 30 oxide coverage on the various textured substrates which produced the shells of FIGS. 11 to 14.

FIGS. 11, 12, 13 and 14 are photomicrographs showing surface nucleation of shells solidified onto four different substrates having textures provided respectively by regular ridges of 180 micron pitch by 20 micron depth (FIG. 11); regular ridges of 180 micron pitch by 60 micron depth (FIG. 12); regular pyramid projections of 160 micron spacing and 20 micron height (FIG. 13) and a grit blasted substrate having a Arithmetic Mean Roughness Value of 10 Ra (FIG. 14). FIGS. 11 and 12 show extensive nucleation band areas corresponding to the texture ridges over which liquid oxides spread during initial solidification. FIGS. 13 and 14 exhibit smaller nucleation areas demonstrating a smaller spread of oxides. FIG. 15 plots respective oxide coverage measurements derived by image analysis of the images advanced in FIGS. 11 to 14 and provides a measurement of the radically reduced oxide coverage resulting from a pattern of discrete projections. This figure shows that the oxide coverage for the grit blasted substrate was much the same as for a regular grid pattern of pyramid projections of 20 micron height and 160 micron spacing.

Figure 16:
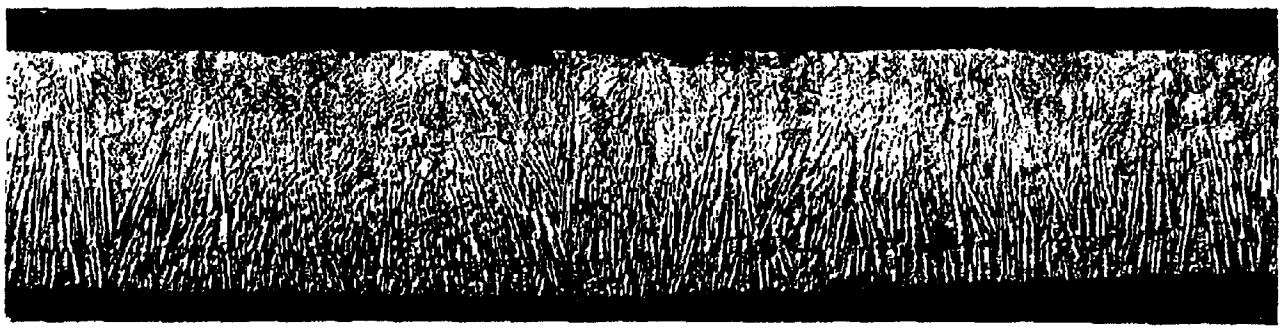
FIGS. 16 and 17 are photomicrographs showing transverse sections through shells deposited from a common steel melt and at the same casting speed onto grit blasted and ridged textured substrates.
Figure 17:
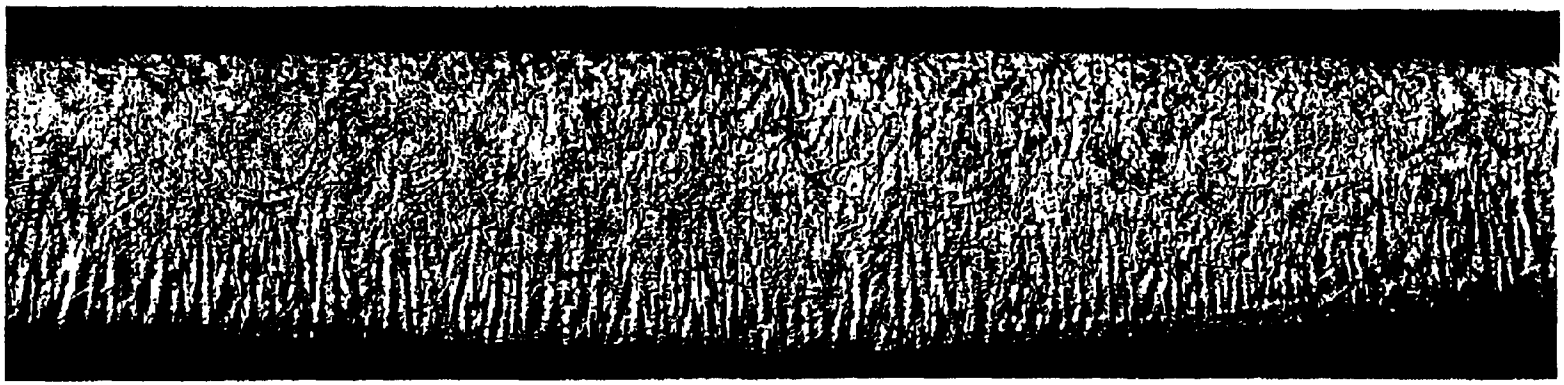

FIGS. 16 and 17 are photomicrographs showing 35 transverse sections through shells deposited at a casting speed of 60 m/min from a typical 1406 steel melt (with residuals by weight of 0.007% sulphur, 0.44% Cu, 0.00996 Cr, 0.003% Mo, 0.02% Ni, 0.003% Sn) onto a grit blasted copper substrate with a chromium protective coating (FIG. 16) and onto a ridged substrate of 160 micron pitch and 60 micron depth cut into a chrome plated substrate (FIG. 17). It will be seen that the ridged substrate produces a very coarse dendrite structure as solidification proceeds, this being exhibited by the coarse dendrites on the side of the shell remote from the chilled substrate. The grit blast substrate produces as much more homogenous microstructure which is fine throughout the thickness of the sample.

Examination of the microstructure produced by ridged and grit blasted substrates shows that the ridged substrates tend to produce a pattern of dendritic growth in which dendrites fan out from nucleation sites along the ridges. Examination of shells produced with the grit blasted substrates has revealed a remarkably homogenous microstructure which is much superior to the more ordered structures resulting from regular patterned textures.

The randomness of the texture is very important to achieving a microstructure which is homogenous and resistant to crack propagation. The grit blasted texture also results in a dramatic reduction in sensitivity to crocodile-skin and chatter defects and enables high speed casting of low residual steels without sulphur addition. In order to achieve these results it is important that the contact between the steel melt and the casting surface be confined to a random pattern of discrete peaks projecting into the melt. This requires that the discrete projections should have a peaked formation and not have extended top surface areas, and that the surface density and the height of the projections be such that the melt can be supported by the peaks without flowing into the depressed areas between them. Our experimental results and calculations indicate that in order to achieve this result the projections must have an average height of at least 10 microns and that the surface density of the peaks must be between 10 and 100 peaks per $mm^2$.

An appropriate random texture can be imparted to a metal substrate by grit blasting with hard particulate materials such as alumina, silica, or silicon carbide having a particle size of the order of 0.7 to 1.4 mm. For example, a copper roll surface may be grit blasted in this way to impose an appropriate texture and the textured surface protected with a thin chrome coating of the order of 50 microns thickness. Alternatively it would be possible to apply a textured surface directly to a nickel substrate with no additional protective coating.

It is also possible to achieve an appropriate random texture by forming a coating by chemical deposition or electrodeposition. In this case the coating material may be chosen so as to contribute to high thermal conductivity and increased heat flux during solidification. It may also be chosen such that the oxidation products in the steel exhibit poor wettability on the coating material, with the steel melt itself having a greater affinity for the coating material and therefore wetting the coating in preference to the oxides. We have determined that two suitable materials are the alloy of nickel, chromium and molybdenum available commercially under the trade name "HASTALLOY C" and the alloy of nickel, molybdenum and cobalt available commercially under the trade name "T800".

Figure 18:
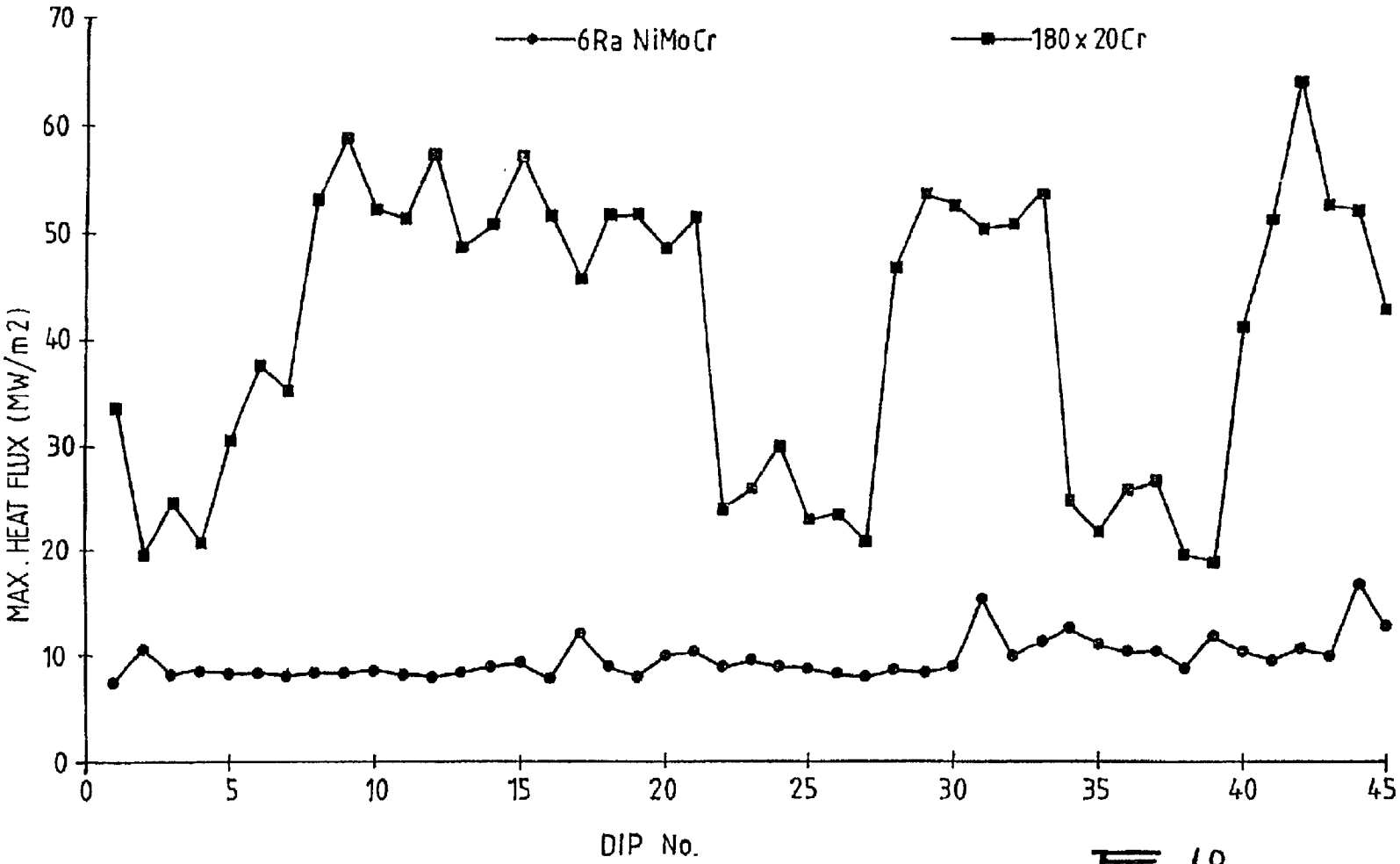
FIG. 18 plots maximum heat flux measurements obtained on successive dip tests using substrates having chrome plated ridges and substrates coated with an alloy of nickel, molybdenum and chrome.

FIG. 18 plots maximum heat flux measurements obtained on successive dip tests using a ridged chromium substrate and in similar tests using a randomly textured substrate of "T800" alloy material. In the tests using a ridged substrate the heat flux values increased to high values as the oxides build up. The oxides were then brushed away after dip No 20 resulting in a dramatic fall in heat flux values followed by an increase due to oxide build up through dips Nos 26 to 32, after which the oxides were brushed away and the cycle repeated. In the tests on the "T800" substrate, the substrate was not cleaned and any oxide deposits were simply allowed to build up throughout the complete cycle of tests.

It will seen that heat flux values obtained with the ridged chromium substrate are higher than with the "T800" substrate but exhibit the typical variations associated with melting and resolidification as the oxides build up which variations cause the crocodile-skin defects in cast strip. The heat flux measurements obtained with the "T800" substrate are lower than those obtained with the ridged chrome surface but they are remarkably even indicating that oxide build up does not create any heat flux disturbances and will therefore not be a factor during casting. The "T800" substrate in these tests had an $R_a$ value of 6 microns.

Figure 19:
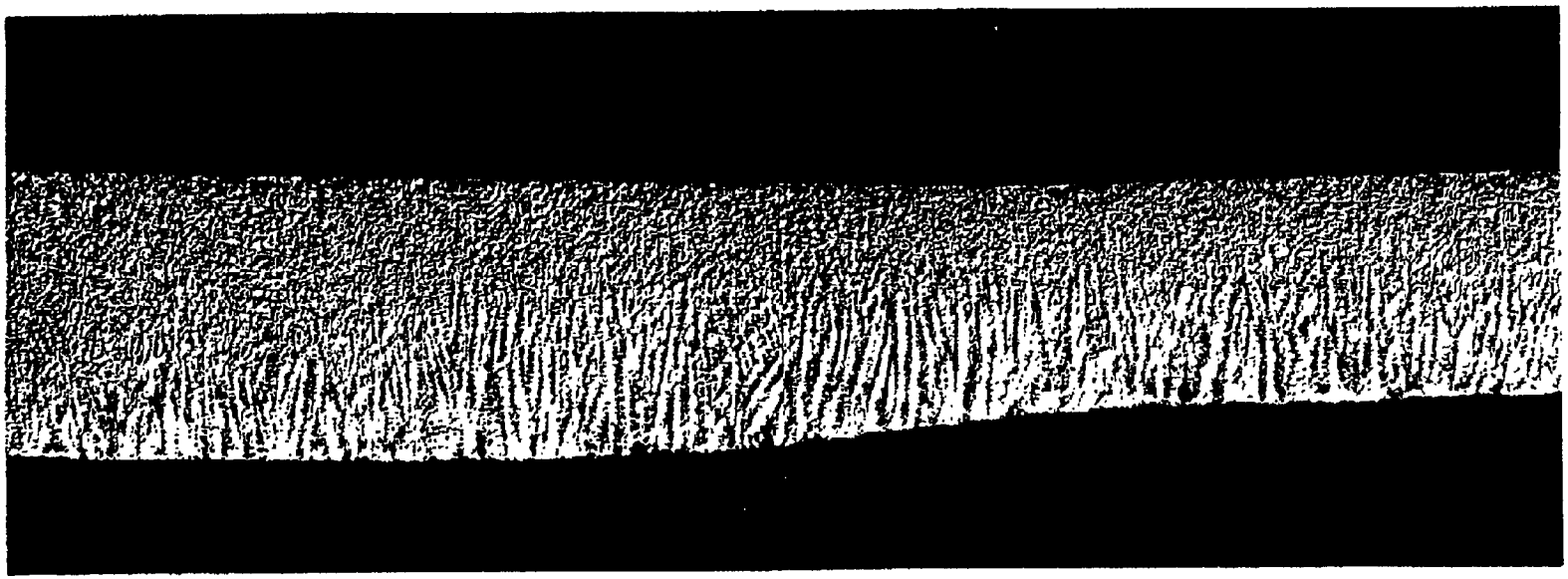
FIGS. 19, 20 and 21 are photomicrographs of steel shells solidified onto the different cooling substrates.
Figure 20:
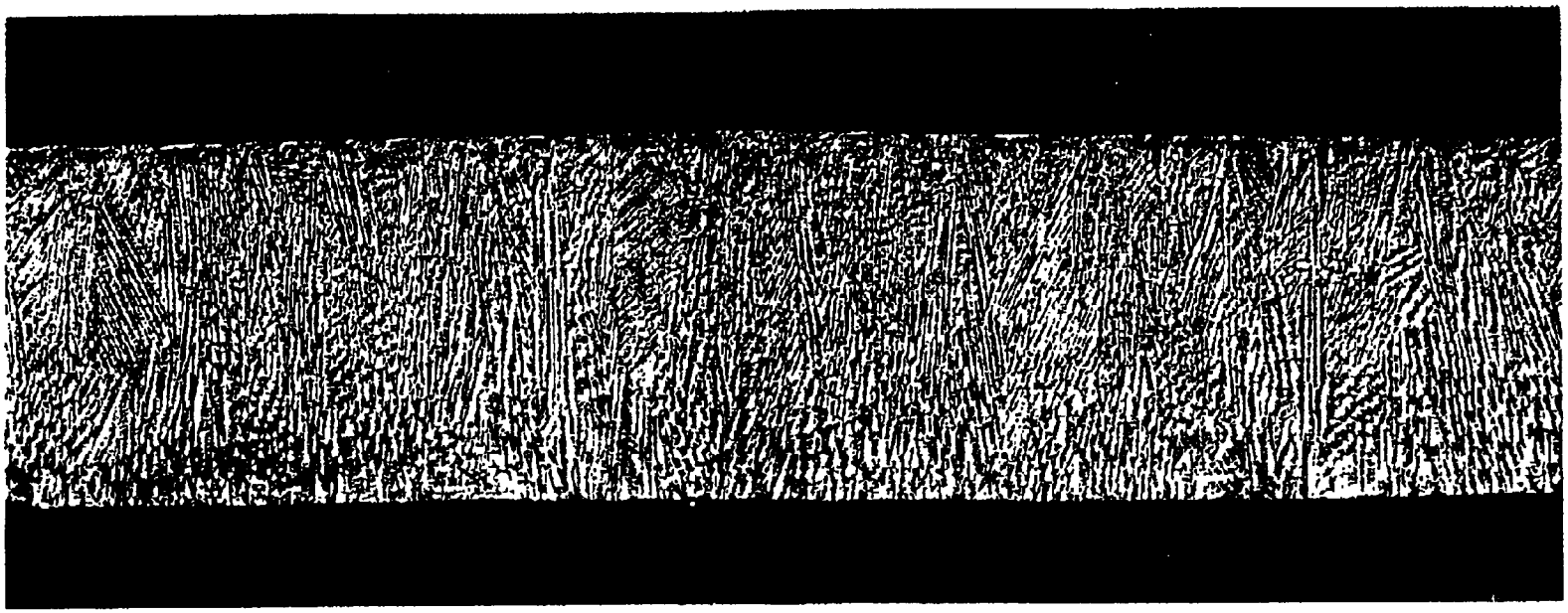

It has also been shown that shells deposited on randomly textured "T800" substrates are of much more even thickness than those deposited on chrome substrates. Measurement of standard deviation of thickness of shells deposited on "T800" substrates have consistently been at least 50% lower than equivalent measurements on shells deposited on ridged chrome substrates, indicating the production of shells of remarkably even thickness not exhibiting any distortions of the kind which produce crocodile-skin deformation. These results are confirmed by microscopic examination of the test shells. FIG. 19 is a photomicrograph of the cross-section of a typical steel shell solidified onto a ridged chromium substrate whereas FIG. 20 shows a photomicrograph of a shell as deposited on a "T800" substrate in the same test. It will be seen that the latter shell is of much more uniform cross-section and also is of more uniform microstructure throughout its thickness.

Figure 21:
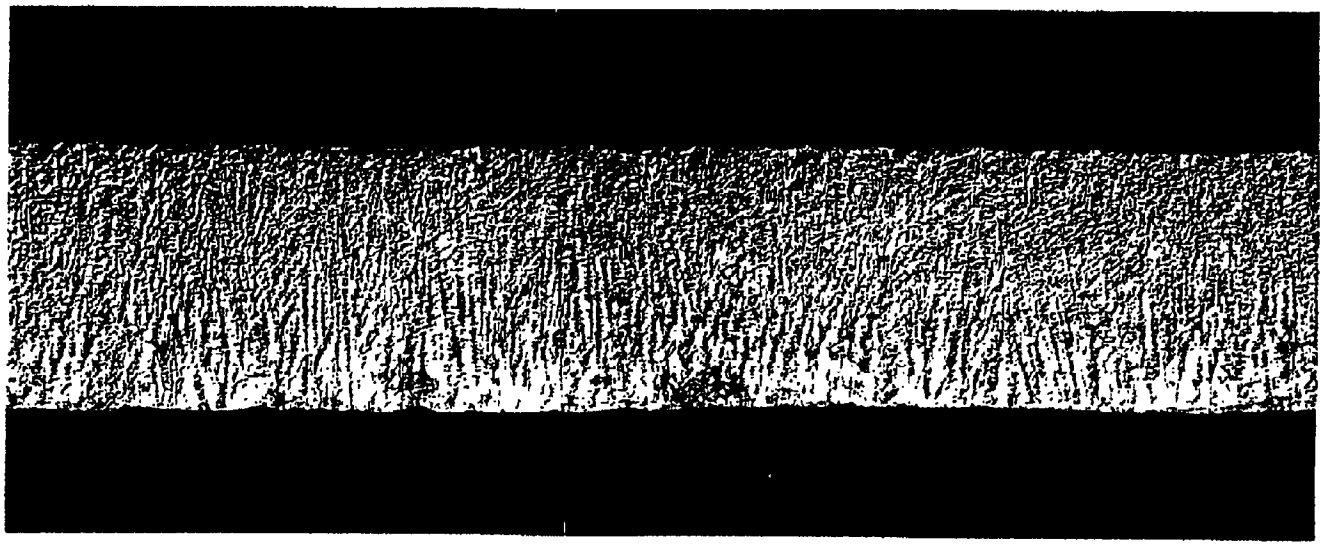
Figure 22:
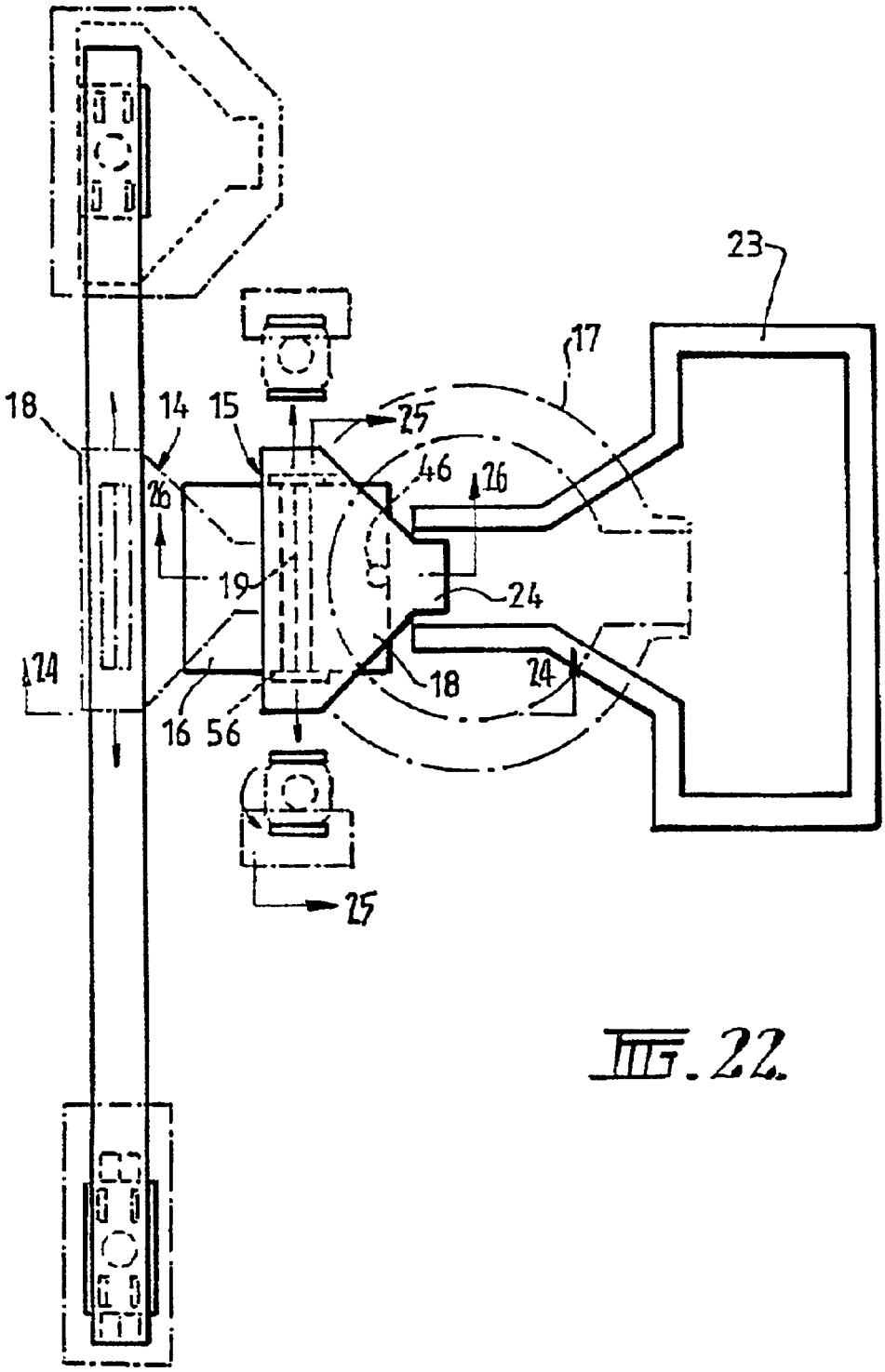
FIG. 22 is a plan view of a continuous strip caster which is operable in accordance with the invention.
Figure 23:
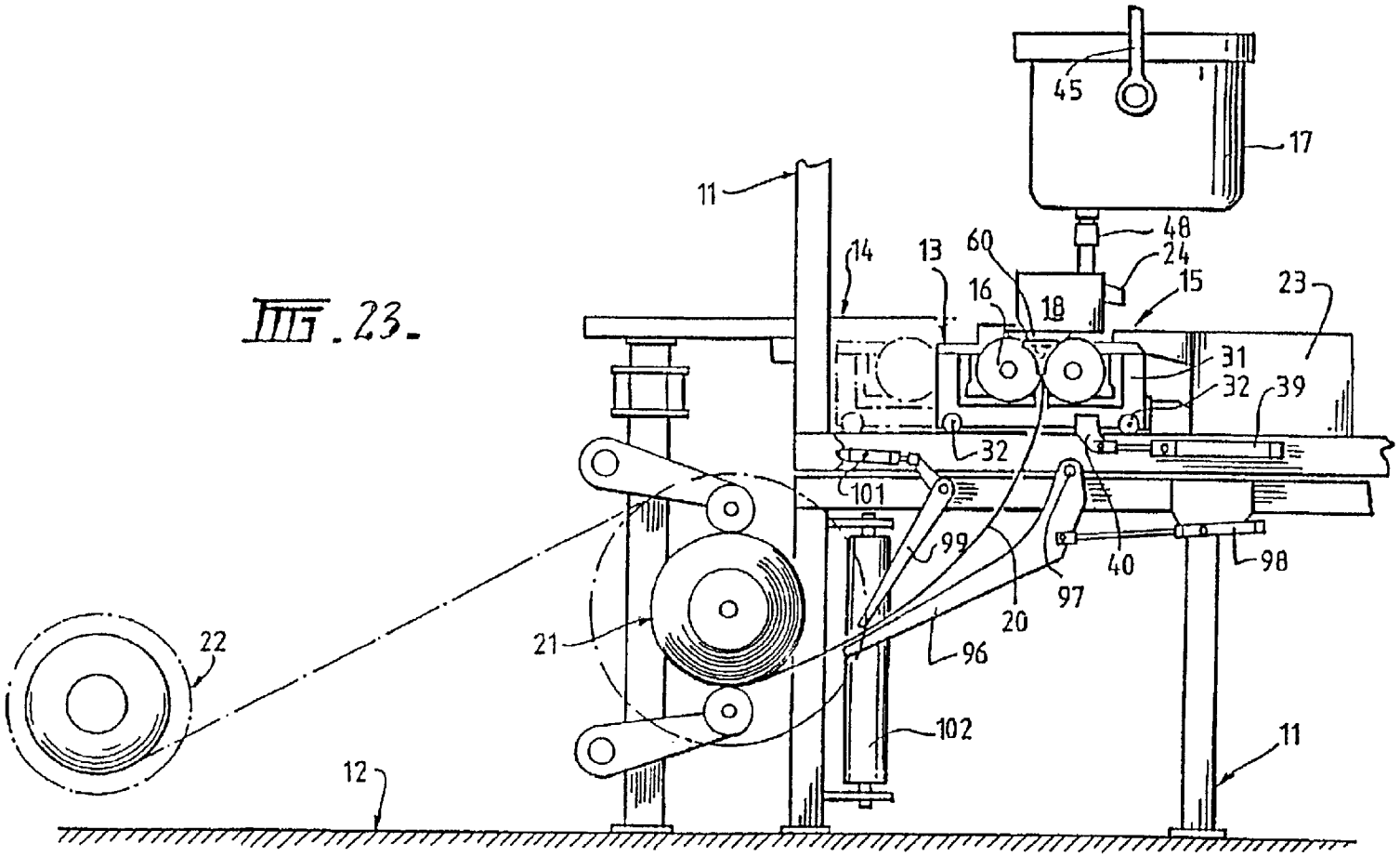
FIG. 23 is a side elevation of the strip caster shown in FIG. 22.
Figure 24:
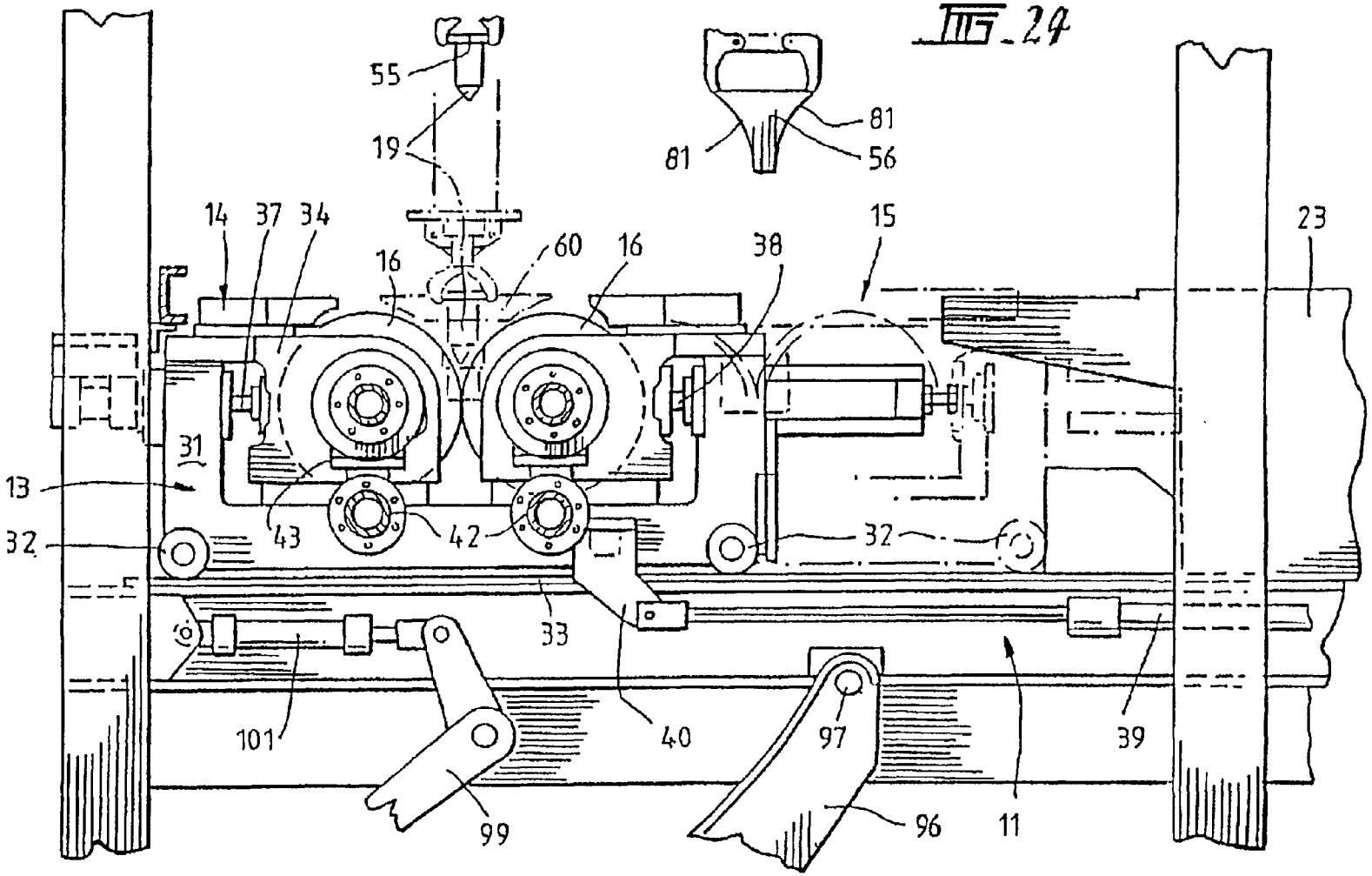
FIG. 24 is a vertical cross-section on the line 24—24 in FIG. 22.
Figure 25:
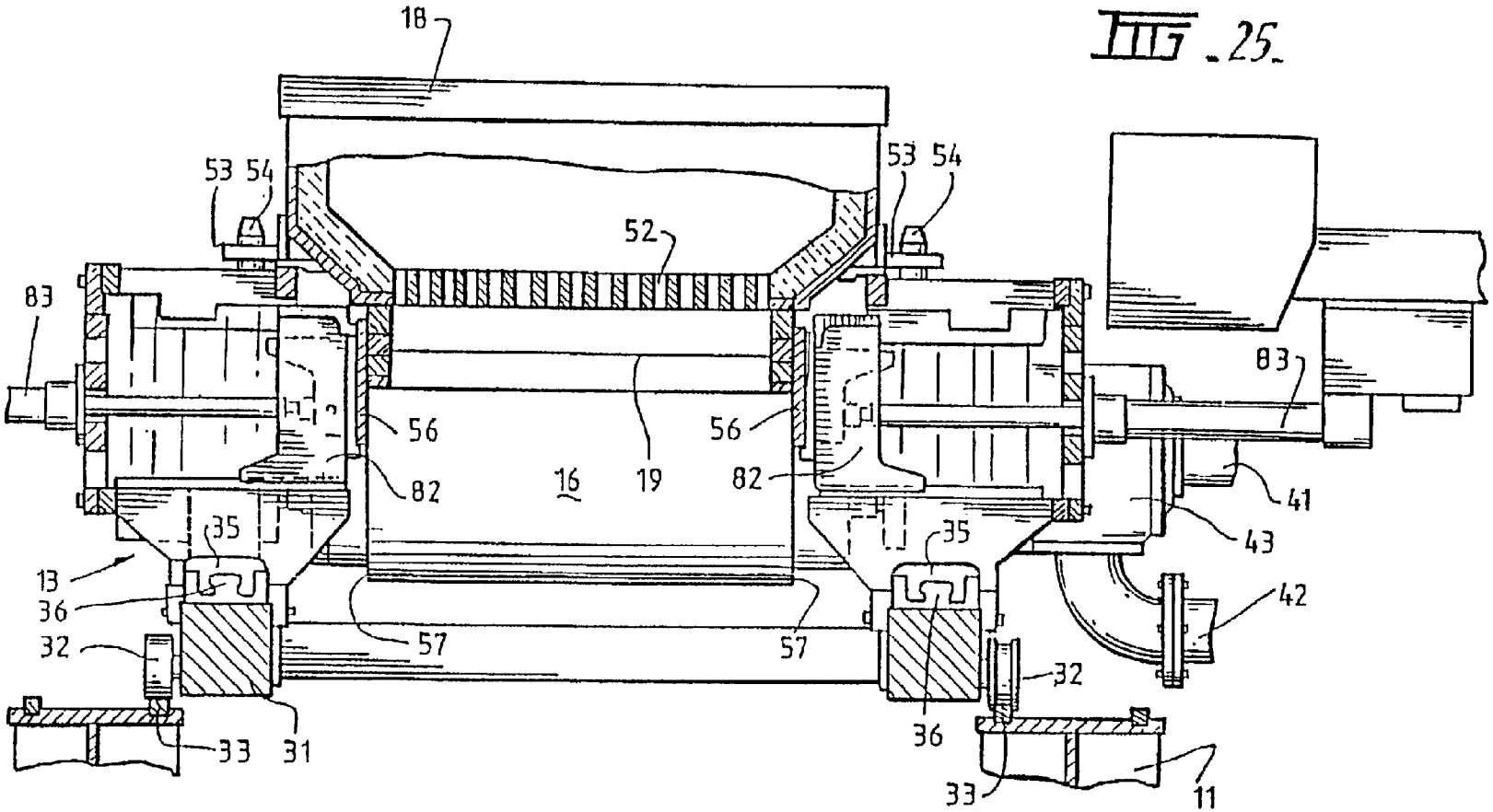
FIG. 25 is a vertical cross-section on the line 25—25 in FIG. 22.
Figure 26:
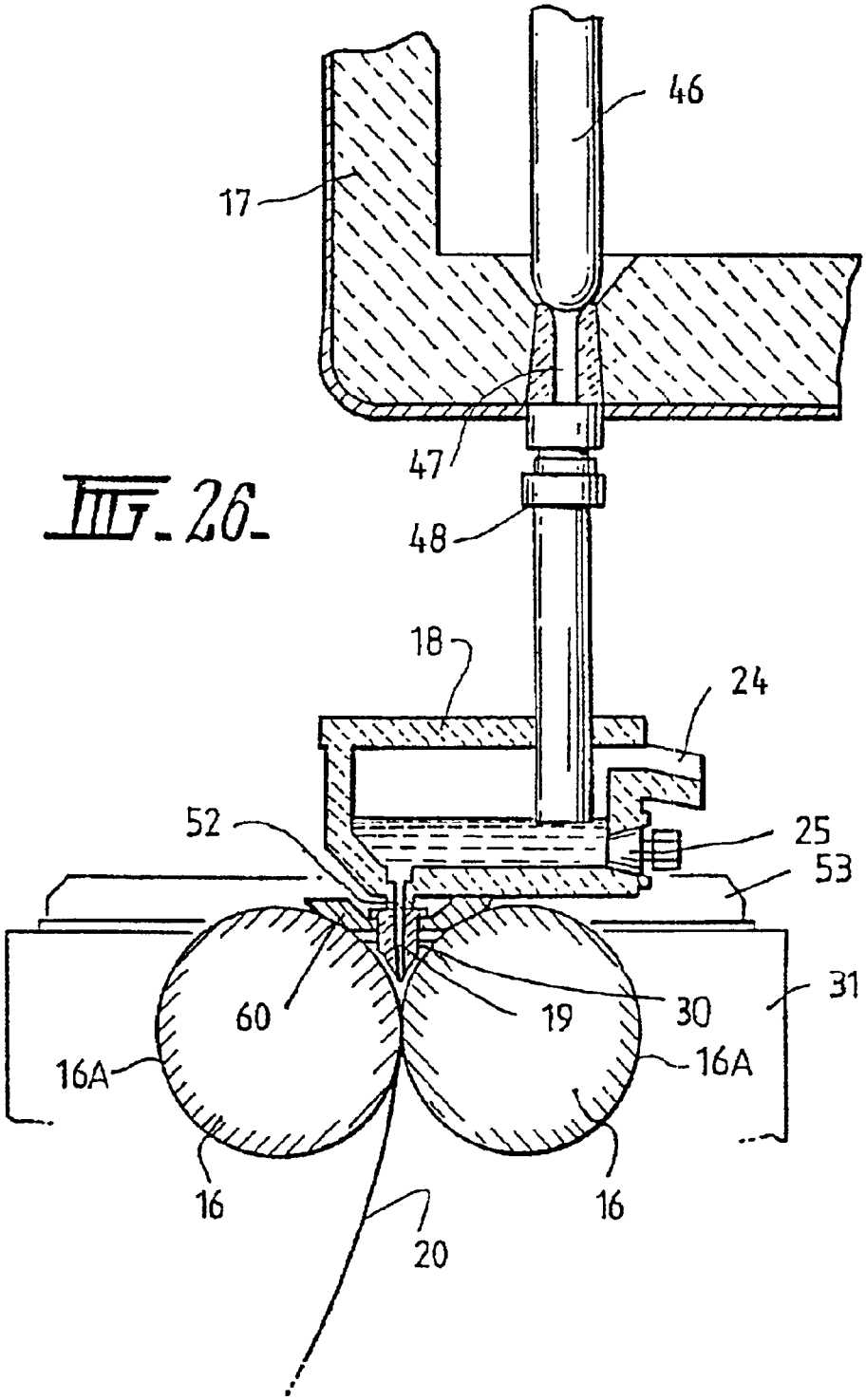
FIG. 26 is a vertical cross-section on the line 26—26 in FIG. 22.

Results similar to those obtained with the "T800" substrate have also been achieved with a randomly textured substrate of "HASTALLOY C". FIG. 21 is a photomicrograph of a shell solidified onto such a substrate. This shell is not quite as uniform or as thick as the shell deposited on the "T800" substrate as illustrated in FIG. 20. This is because the respective MOE steel exhibits slightly lower wettability on the "HASTALLOY C" substrate than on the "T800" substrate and so solidification does not proceed so rapidly. In both cases, however, the shell is thicker and more even than corresponding shells obtained with ridged chromium surfaces and the testing has shown that the solidification is not affected by oxide build up so that cleaning of the casting surfaces will not be a critical factor.

FIGS. 22 to 26 illustrate a twin roll continuous strip caster which may be operated in accordance with the present invention. This caster comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation from a ladle 17 via a distributor 18 and delivery nozzle 19 to create a casting pool 30. Casting rolls 16 are water cooled so that shells solidify on the moving roll surfaces 16A and are brought together at the nip between them to produce a solidified strip product 20 at the roll outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the distributor or by withdrawal of an emergency plug 25 at one side of the distributor if there is a severe malformation of product or other severe malfunction during a casting operation.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles 34 in which the rolls 16 are rotatably mounted. Roll cradles 34 are mounted on the carriage frame 31 by interengaging complementary slide members 35, 36 to allow the cradles to be moved on the carriage under the influence of hydraulic cylinder units 37, 38 to adjust the nip between the casting rolls 16 and to enable the rolls to be rapidly moved apart for a short time interval when it is required to form a transverse line of weakness across the strip as will be explained in more detail below. The carriage is movable as a whole along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and vice versa.

Casting rolls 16 are contra rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The roll may typically be about 500 mm diameter and up to 2000 mm long in order to produce 2000 mm wide strip product. Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into distributor 18.

Distributor 18 is formed as a wide dish made of a refractory material such as magnesium oxide (MgO). One side of the distributor receives molten metal from the ladle and is provided with the aforesaid overflow 24 and emergency plug 25. The other side of the distributor is provided with a series of longitudinally spaced metal outlet openings 52. The lower part of the distributor carries mounting brackets 53 for mounting the distributor onto the roll carriage frame 31 and provided with apertures to receive indexing pegs 54 on the carriage frame so as to accurately locate the distributor.

Delivery nozzle 19 in formed as an elongate body made of a refractory material such as alumina graphite. Its lower part is tapered so as to converge inwardly and downwardly so that it can project into the nip between casting rolls 16. It is provided with a mounting bracket 60 whereby to support it on the roll carriage frame and its upper part is formed with outwardly projecting side flanges 55 which locate on the mounting bracket.

Nozzle 19 may have a series of horizontally spaced generally vertically extending flow passages to produce a suitably low velocity discharge of metal throughout the width of the rolls and to deliver the molten metal into the nip between the rolls without direct impingement on the roll surfaces at which initial solidification occurs. Alternatively, the nozzle may have a single continuous slot outlet to deliver a low velocity curtain of molten metal directly into the nip between the rolls and/or it may be immersed in the molten metal pool.

The pool is confined at the ends of the rolls by a pair of side closure plates 56 which are held against stepped ends 57 of the rolls when the roll carriage is at the casting station. Side closure plates 56 are made of a strong refractory material, for example boron nitride, and have scalloped side edges 81 to match the curvature of the stepped ends 57 of the rolls. The side plates can be mounted in plate holders 82 which are movable at the casting station by actuation of a pair of hydraulic cylinder units 83 to bring the side plates into engagement with the stepped ends of the casting rolls to form end closures for the molten pool of metal formed on the casting rolls during a casting operation.

During a casting operation the ladle stopper rod 46 is actuated to allow molten metal to pour from the ladle to the distributor through the metal delivery nozzle whence it flows to the casting rolls. The clean head end of the strip product 20 is guided by actuation of an apron table 96 to the jaws of the coiler 21. Apron table 96 hangs from pivot mountings 97 on the main frame and can be swung toward the coiler by actuation of an hydraulic cylinder unit 98 after the clean head end has been formed. Table 96 may operate against an upper strip guide flap 99 actuated by a piston and a cylinder unit 101 and the strip product 20 may be confined between a pair of vertical side rollers 102. After the head end has been guided in to the jaws of the coiler, the coiler is rotated to coil the strip product 20 and the apron table is allowed to swing back to its inoperative position where it simply hangs from the machine frame clear of the product which is taken directly onto the coiler 21. The resulting strip product 20 may be subsequently transferred to coiler 22 to produce a final coil for transport away from the caster.

Full particulars of a twin roll caster of the kind illustrated in FIGS. 12 to 16 are more fully described in our U.S. Pat. Nos. 5,184,668 and 5,277,243 and International Patent Application PCT/AU93/00593.

In accordance with the present invention the copper peripheral walls of rolls 16 may be grit blasted to have a random texture of discrete peaked projections of the required depth and surface density and this texture may be protected by a thin chrome plating. Alternatively, the copper walls of the rolls could be coated with nickel and the nickel coating grit blasted to achieve the required random surface texture. In another alternative an alloy such as HASTALLOY C or T800 alloy material may be electrodeposited on the copper walls of the casting rolls.

Figure 27:
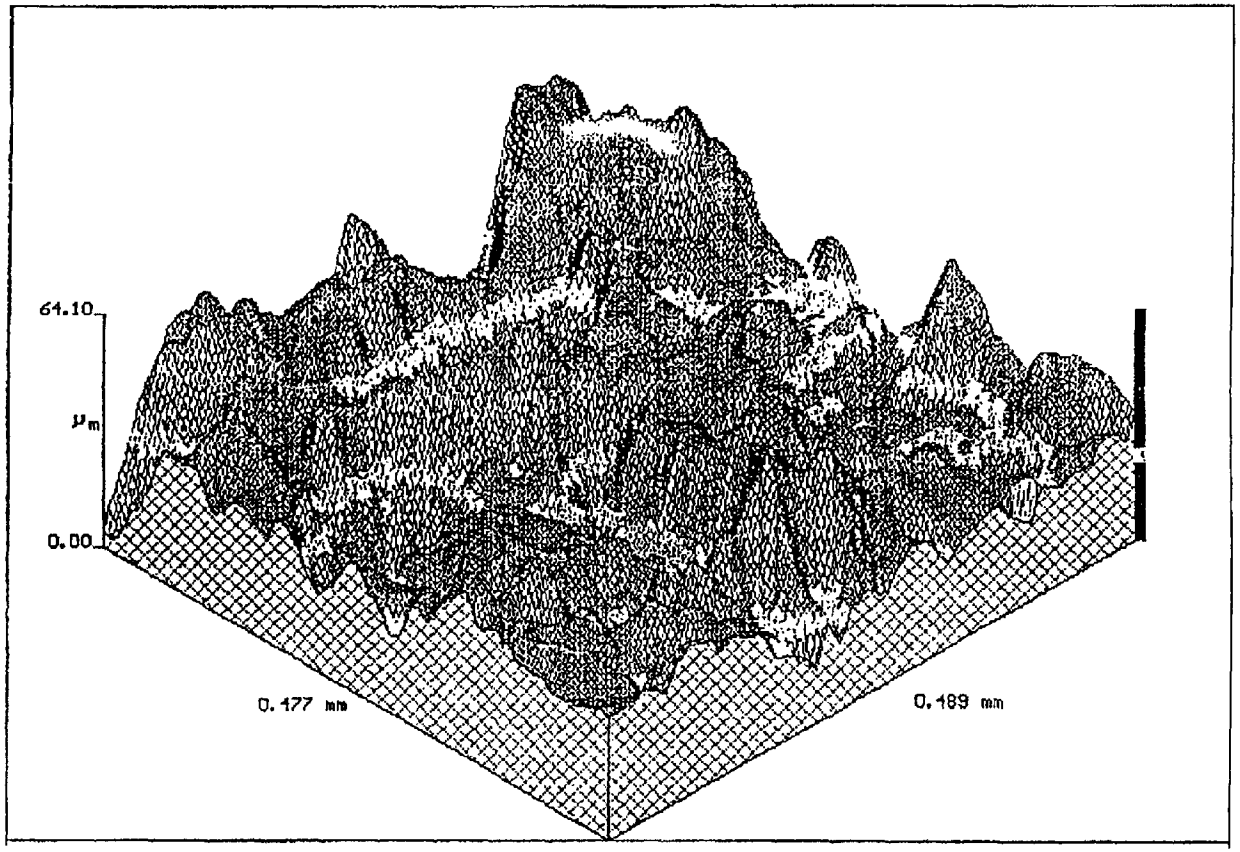
FIG. 27 represents a typical surface texture produced according to the invention.

FIG. 27 represents a typical surface texture with a random pattern of discrete projections produced according to the invention. Typically, the average peak-to-peak spacing between discrete projections is between 130 and 200 microns, so that the average peak distribution of the discrete projections is between 40 and 70 peaks per $mm^2$. The peak spacing was measured using a Surtronics 3+ Taylor Hobson Roughness measuring device, which measures surface roughness (Ra) and the average spacing between discrete projections (Sm) where Sm is measured in millimeters (mms) or microns. The average number of peaks per unit area can then be determined, e.g., number of peaks in 1 $mm^2=[(1/sm)+1]^2$ where Sm is given in mms. Alternatively it would be possible to apply a textured surface with such random pattern of discrete projections directly to a nickel substrate with no additional protective coating.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A method of continuously casting steel strip comprising the steps of:

forming casting rolls with textured casting surfaces by grit blasting before a casting campaign is commenced to provide casting surfaces with discrete projections wherein at least some of the projections include peaks having an average surface distribution of between 5 and 200 peaks per $mm^2$;

supporting a casting pool of molten steel on one or more said formed textured casting surfaces; and moving the chilled casting surface or surfaces to produce a solidified strip moving away from the casting pool.

2. The method as claimed in claim 1, wherein the strip is moved away from the casting pool at a speed of more than 40 meters per minute.

3. The method as claimed in claim 2, wherein the strip is moved away from the casting pool at a speed of between 50 and 65 meters per minute.

4. The method as claimed in claim 1, wherein the molten steel is a low residual steel having a sulphur content of not more than 0.025%.

5. The method as claimed in claim 1, wherein a pair of casting rolls are formed with texture surfaces by grit blasting forming a nip between them, the molten steel is introduced into the nip between the casting rolls to create the casting pool supported on the textured surfaces of the rolls immediately above the nip, and the casting rolls are rotated to deliver the solidified strip downwardly from the nip.

6. The method as claimed in claim 5, wherein the molten steel is delivered into the nip between the casting rolls via a metal delivery nozzle disposed above the nip.

7. The method as claimed in claim 1, wherein each textured casting surface is defined by a grit blasted substrate covered by a protective coating such that the textured pattern shoes in the exterior surface of the protective coating.

8. The method as claimed in claim 7, wherein the protective coasting is an electroplated metal coating.

9. The method as claimed in claim 8, wherein the substrate is copper and the plated coating is of chromium.

10. The method as claimed in claim 1, wherein the textured surface formed by grit blasting is formed of nickel.

11. The method as claimed in claim 1, wherein each casting surface is defined by a coating deposited onto a substrate that is then grit blasted to form the casting surface of a random texture.

12. The method as claimed in claim 11, wherein the coating is formed by chemical deposition.

13. The method as claimed in claim 11, wherein the coating is formed by electrodeposition.

14. The method as claimed in claim 11, wherein the coating is formed of a material which has a low affinity for the oxidation products in the molten steel such that the molten steel itself has greater affinity for the coating material and therefore wets the coating in preference to said oxidation products.

15. The method as claimed in claim 11, wherein the coating is formed of an alloy of nickel, chromium and molybdenum.

16. The method as claimed in claim 11, wherein the coating is formed of an alloy of nickel, molybdenum and cobalt.

17. The method as claimed in claim 1, wherein said discrete projections have an average height of at least 10 microns.

18. The method as claimed in claim 1, wherein at least some of the discrete projections include peaks having an average surface distribution of between 10 and 100 peaks per $mm^2$.

19. The method of claim 1, wherein said discrete projections have an average height of at least 20 microns.

20. An apparatus for continuously casting steel strip comprising:

forming a pair of casting rolls each with textured casting surfaces by grit blasting before the casting campaign is commenced where the casting surfaces have discrete projections wherein at least some of the projections include peaks having an average surface distribution of between 5 and 200 peaks per $mm^2$;

assembling the cast rolls with said formed textured casting surfaces into a twin roll caster with the pair of casting rolls horizontally assembled to form a nip between them, a molten steel delivery nozzle for delivery of molten steel into the nip between the casting rolls to form a casting pool of molten steel supported on said textured casting roll surfaces immediately above the nip, and a roll drive that moves the casting rolls in counter-rotational directions to produce a solidified steel strip delivered downwardly from the nip.

21. The apparatus as claimed in claim 20, wherein the textured casting surfaces of the rolls are each defined by a grit blasted substrate covered by a protective coating.

22. The apparatus as claimed in claim 21, wherein the protective coating is an electroplated metal coating.

23. The apparatus as claimed in claim 22, wherein the substrate is copper and the plated coating is of chromium.

24. The apparatus as claimed in claim 20, wherein the textured casting surfaces of the rolls formed by grit blasting are formed of nickel.

25. The apparatus as claimed in claim 20, wherein the casting surfaces of the rolls are each defined by a coating deposited onto a substrate so as to produce a random texture.

26. The apparatus as claimed in claim 25, wherein the coating is formed by chemical deposition.

27. The apparatus as claimed in claim 25, wherein the coating is formed by electrodeposition.

28. The apparatus as claimed in claim 25, wherein the coating is formed of an alloy of a nickel of nickel, chromium and molybdenum.

29. The apparatus as claimed in claim 25, wherein the coating is formed of an alloy of nickel, molybdenum and cobalt.

30. The method as claimed in claim 20, wherein said discrete projections have an average height of at least 10 microns.

31. The method of claim 20, wherein the average height of the discrete projections is at least 20 microns.

32. An apparatus for continuously casting steel strip comprising:

forming a pair of casting rolls before a casting campaign with the each casting roll having textured casting surfaces by grit blasting with discrete projections at least some of which include peaks having an average surface distribution of between 10 and 100 peaks per $mm^2$ and an average height of at least 10 microns with the pair of casting rolls horizontally assembled to form a nip between them, a molten steel delivery nozzle for delivery of molten steel into the nip between the casting rolls to form a casting pool of molten steel supported on said textured casting roll surfaces immediately above the nip, and a roll drive that drives the casting rolls in counter-rotational directions to produce a solidified steel strip delivered downwardly from the nip.

33. The apparatus of claim 32, wherein said discrete projections have an average height of at least 20 microns.

* * * * *

UNITED STATES PATENT AND TRADEMARK OFFICE

CERTIFICATE OF CORRECTION

PATENT NO. : 6,942,013 B2
APPLICATION NO. : 10/164131
DATED : September 13, 2005
INVENTOR(S) : Lazar Strezov et al.

It is certified that error appears in the above-identified patent and that said Letters Patent is hereby corrected as shown below:

On title page, item (63) Related U.S. Application Data
add at end of paragraph
--, which is a U.S. National stage application of PCT/AU99/00641, filed August 6, 1991--.

Col. 1, line 6 - replace "which application claims priority to" with
--which application is a U.S. National stage application of--

Col. 4, line 61 - replace "measurements of 5 standard" with
--measurements of standard--

Col. 5, line 3 - replace "surface 15 of a" with
--surface of a--

Col. 5, line 14 - replace "the surface of 25 a shell" with
--the surface of a shell--

Col. 5, line 19 - replace "percentage melt 30 oxide" with
--percentage melt oxide--

Col. 7, line 14 - replace "obtained during 10 solidi-" with
--obtained during solidi- --

Col. 7, line 63 - replace "the surface of a 25 shell" with
--the surface of a shell--

Col. 8, line 39 - replace "showing 35 trans-" with
--showing trans- --

Col. 10, line 17 - replace "respective MOE steel exhibits" with
--respective M06 steel exhibits--

UNITED STATES PATENT AND TRADEMARK OFFICE

CERTIFICATE OF CORRECTION

PATENT NO. : 6,942,013 B2
APPLICATION NO. : 10/164131
DATED : September 13, 2005
INVENTOR(S) : Lazar Strezov et al.

It is certified that error appears in the above-identified patent and that said Letters Patent is hereby corrected as shown below:

Col 13., claim 7, line 14 - replace “shoes in the exterior” with
--shows in the exterior--

Signed and Sealed this

Sixth Day of November, 2007

JON W. DUDAS
*Director of the United States Patent and Trademark Office*